US008225763B2

(12) United States Patent
Nakano et al.

(10) Patent No.: US 8,225,763 B2
(45) Date of Patent: Jul. 24, 2012

(54) HYDRAULIC ACTUATOR CONTROL DEVICE AND HYDRAULIC ACTUATOR CONTROL METHOD

(75) Inventors: Tomohiro Nakano, Susono (JP); Shuji Yuda, Gotenba (JP); Masakatsu Nagai, Hiratsuka (JP); Takahiro Uchida, Gotenba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 505 days.

(21) Appl. No.: 12/443,742

(22) PCT Filed: Jan. 18, 2008

(86) PCT No.: PCT/IB2008/000110

§ 371 (c)(1),
(2), (4) Date: Mar. 31, 2009

(87) PCT Pub. No.: WO2008/087539

PCT Pub. Date: Jul. 24, 2008

(65) Prior Publication Data

US 2010/0006045 A1 Jan. 14, 2010

(30) Foreign Application Priority Data

Jan. 19, 2007 (JP) ..... 2007-010308

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | |
|---|---|---|---|
| 5,628,286 | A | 5/1997 | Kato et al. |
| 6,196,174 | B1 | 3/2001 | Wada et al. |
| 2003/0000489 | A1 | 1/2003 | Majima et al. |
| 2003/0066501 | A1 | 4/2003 | Park |
| 2003/0164149 | A1 | 9/2003 | Kondou et al. |

FOREIGN PATENT DOCUMENTS

| | | |
|---|---|---|
| DE | 102 22 680 | 5/2003 |
| EP | 1 340 887 | 9/2003 |
| JP | 7 26992 | 1/1995 |
| JP | 7 269380 | 10/1995 |
| JP | 8 326512 | 12/1996 |
| JP | 10 2301 | 1/1998 |
| JP | 10 169603 | 6/1998 |
| JP | 10 220258 | 8/1998 |
| JP | 10 259743 | 9/1998 |

(Continued)

*Primary Examiner* — Zelalem Eshete
(74) *Attorney, Agent, or Firm* — Oblon, Spivak, McClelland, Maier & Neustadt, L.L.P.

(57) ABSTRACT

In a hydraulic actuator control device, a changing tendency of responsiveness of a hydraulic actuator to changes in the oil control valve (OCV) drive duty of a virtual OCV is stored as model control characteristics. The ratio of an actual OCV dead zone width to a virtual OCV dead zone width is calculated as an OCV variation correction coefficient. A basic control amount is calculated based on a deviation between an operating amount and a target operating amount of the hydraulic actuator. An actual OCV in-dead-zone control amount is obtained by correcting a virtual OCV in-dead-zone control amount with the OCV variation correction coefficient, and an actual OCV out-of-dead-zone control amount is calculated based on a virtual OCV out-of-dead-zone control amount. The actual OCV control amount is the sum of the actual OCV in-dead-zone control amount and the actual OCV out-of-dead-zone control amount.

20 Claims, 15 Drawing Sheets

FOREIGN PATENT DOCUMENTS

| | | |
|---|---|---|
| JP | 10 266877 | 10/1998 |
| JP | 11 36905 | 2/1999 |
| JP | 11 62641 | 3/1999 |
| JP | 2000 230437 | 8/2000 |
| JP | 2001 55936 | 2/2001 |
| JP | 2001 82188 | 3/2001 |
| JP | 2003 336529 | 11/2003 |

HYDRAULIC ACTUATOR CONTROL DEVICE AND HYDRAULIC ACTUATOR CONTROL METHOD

BACKGROUND OF THE INVENTION

1. Field of the Invention

The present invention relates to a hydraulic actuator control device and a hydraulic actuator control method. In particular, the invention relates to a hydraulic actuator control device and a hydraulic actuator control method used in a variable valve timing mechanism that variably controls the opening and closing timing of an intake valve or an exhaust valve of an internal combustion engine.

2. Description of the Related Art

In a variable valve timing mechanism, a hydraulic actuator is used to change the displacement angle of a cam shaft relative to a crank shaft. The hydraulic actuator is provided with two oil chambers, i.e., an advance-side oil chamber and a retard-side oil chamber. The valve timing is advanced by supplying pressurized oil to the advance-side oil chamber and discharging the pressurized oil from the retard-side oil chamber, and is retarded by supplying the pressurized oil to the retard-side oil chamber and discharging the pressurized oil from the advance-side oil chamber.

The supply and discharge of the pressurized oil to and from the two oil chambers of the hydraulic actuator is controlled by an oil control valve (OCV). The oil control valve controls the supply and discharge of the pressurized oil depending on the position of a spool within a sleeve. When the spool stays in a neutral region within the sleeve, the two oil chambers are prevented from communicating with a hydraulic pump and an oil tank. If the spool moves from the neutral region to an advance side, the advance-side oil chamber is connected to the hydraulic pump, and the retard-side oil chamber is connected to the oil tank. If the spool moves in a direction opposite the advance side (i.e., to a retard side), the retard-side oil chamber is connected to the hydraulic pump, and the advance-side oil chamber is connected to the oil tank. The spool is driven by a solenoid, and the position thereof is controlled by the value of the duty current that is output to the solenoid.

In the oil control valve, the neutral region within the sleeve has a specified width. When the spool moves within the neutral region, the supply and discharge of the pressurized oil to and from the two oil chambers is minimal. For this reason, in the variable valve timing mechanism, a dead zone in which the valve timing does not respond to or shows reduced responsiveness when the duty current value changes exists near a duty that makes the supply amount of the pressurized oil nearly zero, i.e., a duty that holds the current valve timing.

When advancing the valve timing, the duty that is output to the control valve is changed from a holding duty to an increased duty. In contrast, when retarding the valve timing, the duty that is output to the control valve is changed from the holding duty to a decreased duty. At this time, a valve timing changing speed is kept small until the duty gets out of the dead zone. As soon as the duty gets out of the dead zone, the valve timing starts to be rapidly changed in accordance with the duty value. In this way, presence of the dead zone heavily affects controllability of the valve timing.

Japanese Patent Application Publication No. JP-A-2003-336529 describes a technique for learning the upper and lower end values of a dead zone during controlling valve timing. With the technique described in the Japanese Patent Application Publication No. JP-A-2003-336529, the duty when the actual value of the valve timing begins to be changed toward a target value of the valve timing in response to a change in the target value is learned as the upper or lower end value of the dead zone.

Variations due to individual differences of control valves exist in control characteristics of a variable valve timing mechanism, i.e., changing tendency of responsiveness of valve timing to a change in duty. Even within an individual control valve, variations in control characteristics occur depending on an oil temperature or other conditions. In order to accurately control the valve timing, it is necessary to precisely determine the control characteristics of the variable valve timing mechanism and then to decide the duty to be output to the control valve, based on the control characteristics thus determined.

According to the related art, the upper and the lower value of the dead zone or the holding duty may be determined by conducting learning through valve timing control. Therefore, it is believed that accurate duty control may be executed within the dead zone. However, because accurate determination of the control characteristics outside the dead zone is not conducted in the related art, there is no choice but to leave the duty control outside the dead zone as it stands.

SUMMARY OF THE INVENTION

The invention provides a hydraulic actuator control device and a hydraulic actuator control method that prevent the controllability of a hydraulic actuator from being affected by variations in control characteristics of the hydraulic actuator due to individual differences of control valves.

In accordance with a first aspect of the invention, a hydraulic actuator control device is provided that includes a hydraulic actuator operated by the supply and discharge of pressurized oil and a control valve that controls the supply and discharge of the pressurized oil to and from the hydraulic actuator. The hydraulic actuator control device controls the operation of the hydraulic actuator by outputting a control signal to the control valve. The hydraulic actuator control device includes a dead zone determining unit, a holding value setting unit, a storing unit, a correspondence coefficient calculating unit, a model holding value calculating unit, a model control amount calculating unit, an in-dead-zone control amount calculating unit, an out-of-dead-zone control amount calculating unit, and a control signal setting unit. The dead zone determining unit that determines the dead zone in which the hydraulic actuator does not respond to or shows reduced responsiveness to changes in the control signal, the dead zone falling within a signal region over which the control signal is output. The holding value setting unit sets a value of the control signal at a moment when an operating speed of the hydraulic actuator becomes zero (hereinafter referred to as a holding value). The storing unit stores, as model control characteristics, a changing tendency of responsiveness of the hydraulic actuator to changes in the control signal realized by a virtual model control valve. The correspondence coefficient calculating unit calculates a ratio of a width of the dead zone to a width of a model dead zone of the model control characteristics, as a coefficient for causing the control valve of the control device and the model control valve to correspond to each other (hereinafter referred to as a correspondence coefficient). The model holding value calculating unit calculates a value obtained by correcting the deviation between a center value of the dead zone and the holding value with the correspondence coefficient, as a control signal value when the operating speed of the hydraulic actuator becomes zero in the model control characteristics (hereinafter referred to as a model holding value). The model control amount calculating unit calculates a control amount whose reference is the model holding value of the model control valve (hereinafter referred to as a model control amount), based on the deviation between an operating amount and a target operating amount of the hydraulic actuator. The in-dead-zone control amount calculating unit calculates a value obtained by correcting a model in-dead-zone control amount of the model control amount falling within the model dead zone with the correspondence coefficient, as an in-dead-zone control amount of the control valve. The out-of-dead-zone control amount calculating unit calculates an out-of-dead-zone control amount of the control valve, based on a model out-of-dead-zone control amount of the model control amount falling outside the model dead zone. The control signal setting unit sets a control signal to be output to the control valve, based on the holding value, the in-dead-zone control amount and the out-of-dead-zone control amount.

According to the first aspect of the invention, the actual control characteristics are estimated from the model control characteristics corresponding to the virtual model control valve and the minimum data (the dead zone and the holding value) regarding the actual control characteristics, and the operation of the hydraulic actuator is controlled based on the actual control characteristics. As compared to when the hydraulic actuator is left as it stands, this improves the controllability of the hydraulic actuator, particularly controllability in a zone outside the dead zone.

In accordance with a second aspect of the invention, if the hydraulic actuator is operated in a positive direction when the control signal value is set greater than an upper end value of the dead zone, the dead zone determining unit calculates an overshoot amount of the actual operating amount relative to the target operating amount and decreases the upper end value in accordance with the overshoot amount, if the operating amount of the hydraulic actuator exceeds the target operating-amount According to the second aspect of the invention, the upper end value of the dead zone is corrected according to the overshoot amount to ensure that the operating amount of the hydraulic actuator does not exceed the target operating-amount in the positive direction. This further improves the controllability of the hydraulic actuator.

In accordance with a third aspect of the invention, if the hydraulic actuator is operated in a negative direction when the control signal value is set smaller than a lower end value of the dead zone, the dead zone determining unit calculates an undershoot amount of an actual operating amount relative to the target operating amount and increases the lower end value in accordance with the undershoot amount, if the operating amount of the hydraulic actuator falls below the target operating amount.

According to the third aspect of the invention, the lower end value of the dead zone is corrected according to the undershoot amount to ensure that the operating amount of the hydraulic actuator does not exceed the target operating amount in the negative direction. This further improves the controllability of the hydraulic actuator.

In accordance with a fourth aspect of the invention, the out-of-dead-zone control amount calculating unit calculates a value obtained by correcting the model out-of-dead-zone control amount in accordance with the temperature of the pressurized oil, as the out-of-dead-zone control amount.

According to the fourth aspect of the invention, it is possible to keep the temperature of the pressurized oil from affecting the control characteristics of the hydraulic actuator in a zone outside the dead zone.

In accordance with a fifth aspect of the invention, the in-dead-zone control amount calculating unit corrects the in-dead-zone control amount in accordance with pressurized oil temperature.

According to the fifth invention, it is possible to keep the pressurized oil temperature from affecting the control characteristics of the hydraulic actuator within the dead zone.

In accordance with a sixth aspect of the invention, the hydraulic actuator control device further includes a model dead zone width correcting unit that corrects the model dead zone width in accordance with pressurized oil temperature.

According to the sixth aspect of the invention, it is possible to keep the pressurized oil temperature from affecting the control characteristics of the hydraulic actuator.

In accordance with a seventh aspect of the invention, the hydraulic actuator control device further includes a model dead zone width correcting unit that corrects the model dead zone width in accordance with pressurized oil pressure.

According to the seventh aspect of the invention, it is possible to keep the pressurized oil pressure from affecting the control characteristics of the hydraulic actuator.

In accordance with a eighth aspect of the invention, the hydraulic actuator control device further includes a model dead zone width correcting unit that corrects the model dead zone width in accordance with the viscosity of the pressurized oil.

According to the eighth aspect of the invention, it is possible to keep the viscosity of the pressurized oil from affecting the control characteristics of the hydraulic actuator.

In accordance with a ninth aspect of the invention, the hydraulic actuator control device further includes a model dead zone width correcting unit that corrects the model dead zone width in accordance with the engine speed.

According to the ninth aspect of the invention, it is possible to keep the engine speed from affecting the control characteristics of the hydraulic actuator.

In accordance with a tenth aspect of the invention, the hydraulic actuator control device further includes a correspondence coefficient correcting unit that decreases the correspondence coefficient if the deviation between the operating amount and the target operating amount of the hydraulic actuator converges within a prescribed range.

According to the tenth aspect of the invention, it is possible to suppress fluctuation of the control signal after the operating amount of the hydraulic actuator has converged to the target operating amount, which in turn makes it possible to stably maintain the operating amount of the hydraulic actuator at the target operating amount.

In accordance with a eleventh aspect of the invention, the hydraulic actuator control device further includes an inhibiting unit that inhibits output of the control signal to the control valve until a pressurized oil pressure exceeds a prescribed reference value.

According to the eleventh aspect of the invention, the hydraulic actuator starts operating once the pressurized oil pressure has been sufficiently pressurized. This prevents the occurrence of problems that may otherwise occur if the hydraulic actuator is operated under a low oil pressure.

In accordance with a twelfth aspect of the invention, the holding value setting unit learns the holding value while controlling the operation of the hydraulic actuator, and the control signal setting unit adopts the learned holding value as a basic value of a control reference by which to set the control signal and allows the control reference to approach the center value of the dead zone as the pressurized oil temperature decreases.

According to the twelfth aspect of the invention, variations in the control reference for setting the control signal may be avoided, even when the temperature of the pressurized oil is low and its viscosity is high, i.e., in a situation that the learning accuracy of the holding value is not fully assured.

In accordance with a thirteenth aspect of the invention, the holding value setting unit learns the holding value while controlling the operation of the hydraulic actuator, and the control signal setting unit adopts the learned holding value as the basic value of a control reference by which to set the control signal and allows the control reference to approach the center value of the dead zone as the absolute value of the deviation between the operating amount and the target operating amount of the hydraulic actuator increases.

According to the thirteenth aspect of the invention, the greater the deviation between the operating amount and the target operating amount of the hydraulic actuator, the faster the hydraulic actuator responds to a change in the control signal. However, in such a situation, the control reference is allowed to approach a center value of the dead zone. This makes it possible to prevent the learning accuracy of the holding value from affecting the control characteristics of the hydraulic actuator.

In accordance with a fourteenth aspect of the invention, there is provided a hydraulic actuator control device which has a hydraulic actuator operated by supply and discharge of pressurized oil and a control valve that controls the supply and discharge of the pressurized oil to and from the hydraulic actuator. The hydraulic actuator control device controls the operation of the hydraulic actuator with a control signal being output to the control valve. The hydraulic actuator control device includes a dead zone determining unit and a control signal setting unit. The dead zone determining unit determining, by learning, a dead zone in which the hydraulic actuator does not respond to or shows reduced responsiveness to a change in the control signal, the dead zone falling within a signal region over which the control signal is output. The control signal setting unit sets, based on the dead zone, a control signal to be output to the control valve. The dead zone determining unit learns the dead zone when a target operating amount of the hydraulic actuator is stabilized and the value of the control signal being output to the control valve is stabilized.

According to the fourteenth aspect of the invention, the dead zone is learned when the control signal value is stabilized. This increases the learning accuracy of the dead zone. Furthermore, this aspect allows the learning of the dead zone without operating the hydraulic actuator, thereby increasing the opportunity of learning the dead zone.

In accordance with a fifteenth aspect of the invention, the dead zone determining unit calculates a dead zone updated value from the value of the control signal according to a specified rule and updates the dead zone updated value with a learning value of an upper end value of the dead zone if the dead zone updated value is exceeds the learning value of the upper end value of the dead zone.

According to the fifteenth aspect of the invention, the upper end value of the dead zone may be learned from the control signal value when the above-noted conditions are satisfied.

In accordance with a sixteenth aspect of the invention, the dead zone determining unit calculates a dead zone updated value from the value of the control signal according to a specified rule and updates the dead zone updated value with a learning value of a lower end value of the dead zone if the dead zone updated value is below the learning value of the lower end value of the dead zone.

According to the sixteenth aspect of the invention, the lower end value of the dead zone may be learned from the control signal value when the above-noted conditions are satisfied.

In accordance with a seventeenth aspect of the invention, there is provided a hydraulically-operated variable valve timing device that variably controls valve timing of an intake valve or an exhaust valve of an internal combustion engine. The valve timing device has a hydraulic actuator operated by supply and discharge of pressurized oil for changing valve timing, a control valve that controls the supply and discharge of the pressurized oil to and from the hydraulic actuator, and a control device that sends a control signal to the control valve to control the operation of the hydraulic actuator. The control device includes a dead zone determining unit, a holding value setting unit, a storing unit, a correspondence coefficient calculating unit, a model holding value calculating unit, a model control amount calculating unit, an in-dead-zone control amount calculating unit, an out-of-dead-zone control amount calculating unit, and a control signal setting unit. The dead zone determining unit determines the limits of the dead zone in which the hydraulic actuator does not respond to or shows reduced responsiveness to changes in the control signal, the dead zone falling within a signal region over which the control signal is output. The holding value setting unit sets the value of the control signal when the operating speed of the hydraulic actuator becomes zero as a holding value). The storing unit stores, as model control characteristics, a changing tendency of responsiveness of the hydraulic actuator to the change in the control signal realized by a virtual model control valve. The correspondence coefficient calculating unit calculates the ratio of the width of the dead zone to the width of a model dead zone of the model control characteristics, as a coefficient for causing the control valve of the control device and the model control valve to correspond to each other (hereinafter referred to as a correspondence coefficient). The model holding value calculating unit calculates a value obtained by correcting a deviation between a center value of the dead zone and the holding value with the correspondence coefficient, as a control signal value at a moment when the operating speed of the hydraulic actuator becomes zero in the model control characteristics (hereinafter referred to as a model holding value). The model control amount calculating unit calculates a control amount whose reference is the model holding value of the model control valve (hereinafter referred to as a model control amount), based on a deviation between an operating amount and a target operating amount of the hydraulic actuator. The in-dead-zone control amount calculating unit calculates a value obtained by correcting a model in-dead-zone control amount of the model control amount falling within the model dead zone with the correspondence coefficient, as an in-dead-zone control amount of the control valve. The out-of-dead-zone control amount calculating unit calculates an out-of-dead-zone control amount of the control valve, based on a model out-of-dead-zone control amount of the model control amount falling outside the model dead zone. The control signal setting unit sets the control signal that is output to the control valve, based on the holding value, the in-dead-zone control amount and the out-of-dead-zone control amount.

According to the seventeenth aspect of the invention, in a hydraulically-operated variable valve timing device, the actual control characteristics are estimated from the model control characteristics corresponding to the virtual model control valve and the minimum data (the dead zone and the holding value) regarding the actual control characteristics, and the operation of the hydraulic actuator for changing the valve timing is controlled based on the actual control characteristics. As compared to a case that the hydraulic actuator is left as it stands, this improves the controllability of the hydraulic actuator, particularly controllability in a zone outside the dead zone.

In accordance with an eighteenth aspect of the invention, there is provided a hydraulically-operated variable valve timing device that variably controls valve timing of an intake valve or an exhaust valve of an internal combustion engine. The valve timing device including a hydraulic actuator operated by supply and discharge of pressurized oil for changing valve timing, a control valve that controls the supply and discharge of the pressurized oil to and from the hydraulic actuator, and a control device that controls an operation of the hydraulic actuator with a control signal being output to the control valve. The control device includes a dead zone determining unit and a control-signal setting unit. The dead zone determining unit that determines, by learning, a dead zone in which the hydraulic actuator does not respond to or shows reduced responsiveness to a change in the control signal, the dead zone falling within a signal region over which the control signal is output. The control-signal setting unit that sets, based on the dead zone, a control signal to be output to the control valve. The dead zone determining unit learns the dead zone when the target operating amount of the hydraulic actuator and the value of the control signal that is output to the control valve are stabilized.

According to the eighteenth aspect of the invention, the learning of the dead zone is carried out when the control signal value is stabilized. This makes it possible to maintain high the learning accuracy of the dead zone. Furthermore, this aspect makes it possible to learn the dead zone when the hydraulic actuator is not being operated, thereby increasing the opportunity of learning the dead zone.

In accordance with a nineteenth aspect of the invention, a hydraulic actuator control method is provided for a system that includes a hydraulic actuator operated by the supply and discharge of pressurized oil and a control valve that controls the supply and discharge of the pressurized oil to and from the hydraulic actuator. The hydraulic actuator control method controls the operation of the hydraulic actuator by outputting a control signal to the control valve. The hydraulic actuator control method includes: determining the dead zone in which the hydraulic actuator does not respond to or shows reduced responsiveness to changes in the control signal, the dead zone falling within a signal region over which the control signal is output; setting a value of the control signal at a moment when an operating speed of the hydraulic actuator becomes zero (hereinafter referred to as a holding value); storing, as model control characteristics, a changing tendency of responsiveness of the hydraulic actuator to changes in the control signal realized by a virtual model control valve; calculating a ratio of a width of the dead zone to a width of a model dead zone of the model control characteristics, as a coefficient for causing the control valve of the control device and the model control valve to correspond to each other (hereinafter referred to as a correspondence coefficient); calculating a value obtained by correcting the deviation between a center value of the dead zone and the holding value with the correspondence coefficient, as a control signal value when the operating speed of the hydraulic actuator becomes zero in the model control characteristics (hereinafter referred to as a model holding value); calculating a control amount whose reference is the model holding value of the model control valve (hereinafter referred to as a model control amount), based on the deviation between an operating amount and a target operating amount of the hydraulic actuator; calculating a value obtained by correcting a model in-dead-zone control amount of the model control amount falling within the model dead zone with the correspondence coefficient, as an in-dead-zone control amount of the control valve; calculating an out-of-dead-zone control amount of the control valve, based on a model out-of-dead-zone control amount of the model control amount falling outside the model dead zone; and setting a control signal to be output to the control valve, based on the holding value, the in-dead-zone control amount and the out-of-dead-zone control amount.

In accordance with a twentieth aspect of the invention, there is provided a hydraulic actuator control method for a system which has a hydraulic actuator operated by supply and discharge of pressurized oil and a control valve that controls the supply and discharge of the pressurized oil to and from the hydraulic actuator. The hydraulic actuator control method controls the operation of the hydraulic actuator with a control signal being output to the control valve. The hydraulic actuator control method includes: learning a dead zone in which the hydraulic actuator does not respond to or shows reduced responsiveness to a change in the control signal, the dead zone falling within a signal region over which the control signal is output; and setting, based on the dead zone, a control signal to be output to the control valve. The dead zone is learned when a target operating amount of the hydraulic actuator is stabilized and the value of the control signal being output to the control valve is stabilized.

BRIEF DESCRIPTION OF THE DRAWINGS

The above and other features and advantages of the present invention will become apparent from the following description of example embodiments, given in conjunction with the accompanying drawings, in which.

DETAILED DESCRIPTION OF THE EMBODIMENTS

Hereinafter, a first embodiment of the present invention will be described with reference to the accompanying drawings.

Figure 1:
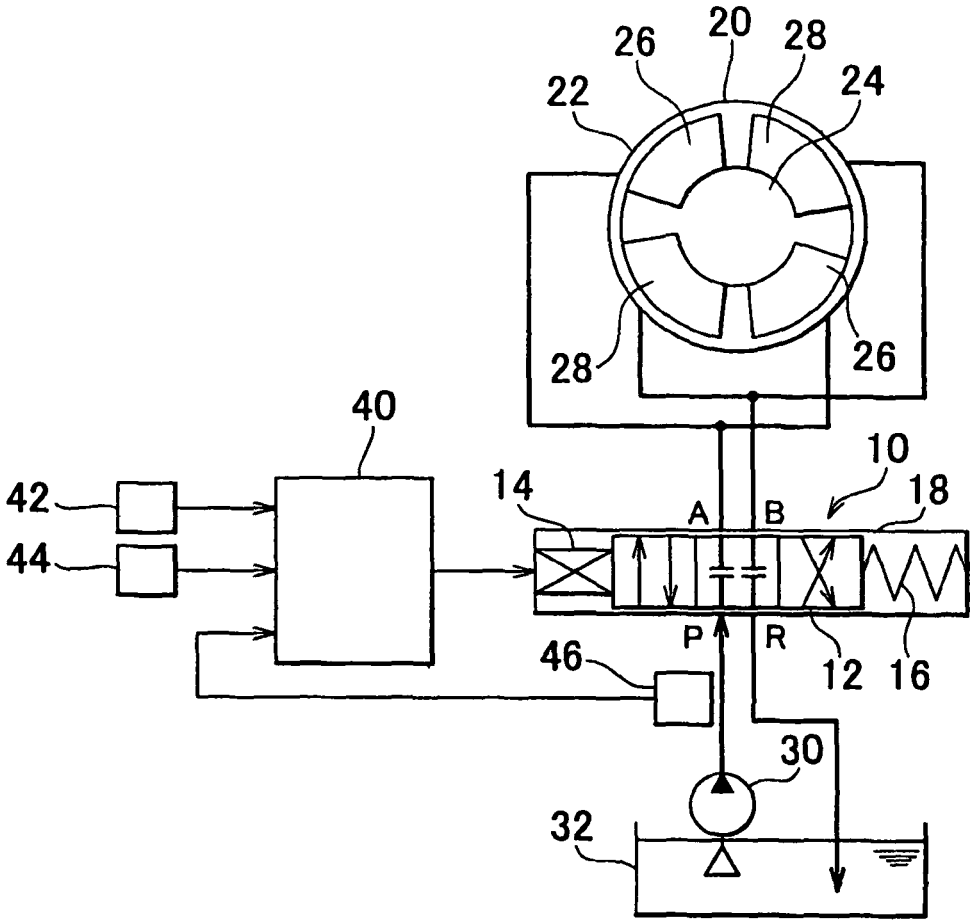
FIG. 1 is a schematic view of a hydraulic system for a variable valve timing mechanism that incorporates a hydraulic actuator control device in accordance with a first embodiment of the present invention.

FIG. 1 is a schematic view of a hydraulic system for a variable valve timing mechanism that incorporates a hydraulic actuator control device in accordance with a first embodiment of the present invention. Although the present embodiment may be used with a variable valve timing mechanism for either an intake valve or an exhaust valve, it is described in the context of a variable valve timing mechanism for an intake valve.

As shown in FIG. 1, the hydraulic system for the variable valve timing mechanism includes a hydraulic actuator 20 that changes the displacement angle of a cam shaft relative to a crank shaft. The hydraulic actuator 20 includes a housing 22 that rotates synchronously with the crank shaft and a rotor 24, arranged within the housing 22, that rotates synchronously with the cam shaft. Oil chambers 26 and 28 are formed inside the housing 22. The rotor 24 divides the oil chambers 26 and 28 into an advance-side oil chamber 26 and a retard-side oil chamber 28.

The hydraulic actuator 20 is operated by supplying pressurized oil to the oil chambers 26 and 28 and changing the displacement angle of the rotor 24 relative to the housing 22. When the pressurized oil is supplied to the advance-side oil chamber 26, the hydraulic actuator 20 is operated to change the displacement angle of the rotor 24 relative to the housing 22 toward the advance side. When the pressurized oil is supplied to the retard-side oil chamber 28, the hydraulic actuator 20 is operated to change the displacement angle of the rotor 24 relative to the housing 22 toward the retard side. As one of the oil chambers supplied with the pressurized oil is enlarged in volume, the pressurized oil is compressed in, and discharged from, the other oil chamber, which is not supplied with pressurized oil.

The pressurized oil supplied to the hydraulic actuator 20 is fed from an oil pump 30 driven by an engine. An oil control valve (hereinafter, referred to as "OCV") 10 is provided between the oil pump 30 and the hydraulic actuator 20. The OCV 10 is a four-port spool valve and controls the supply and discharge of the pressurized oil to and from the oil chambers 26 and 28 of the hydraulic actuator 20 depending on the position of a spool 12 within a sleeve 18. The OCV 10 has an A-port connected to the advance-side oil chamber 26 of the hydraulic actuator 20, a B-port connected to the retard-side oil chamber 28, a P-port connected to the oil pump 30 and an R-port connected to an oil tank 32.

The spool 12 is supported by a spring 16 at one end in its moving direction and by a solenoid 14 at the other end. The position of the spool 12 within the sleeve 18 may be controlled by a duty of a drive current supplied to the solenoid 14 (hereinafter, referred to as an "OCV drive duty"). When the spool 12 is in the position as shown in FIG. 1, the A-port and the B-port are prevented from communicating with the P-port and the R-port and, therefore, the supply and discharge of the pressurized oil to and from the oil chambers 26 and 28 is minimal. The operation region of the spool 12 in which the A-port and the B-port are prevented from communicating with the P-port and the R-port will be referred to as a "neutral region" in this specification.

If the OCV drive duty is increased while the spool 12 is in the neutral region, the spool 12 is displaced by the solenoid 14. Consequently, the A-port communicates with the P-port and the B-port comes into communication with the R-port, whereby the supply of the pressurized oil to the advance-side oil chamber 26 occurs simultaneously with the discharge of the pressurized oil from the retard-side oil chamber 28. The operation region of the spool 12 in which the pressurized oil is supplied to the advance-side oil chamber 26 will be referred to as an "advance region" hereinbelow.

In contrast, if the OCV drive duty is decreased while the spool 12 is in the neutral region, the spool 12 is displaced by the spring 16. Consequently, the A-port communicates with the R-port and the B-port comes into communication with the P-port, whereby the supply of the pressurized oil to the retard-side oil chamber 28 occurs simultaneously with the discharge of the pressurized oil from the retard-side oil chamber 26. The operation region of the spool 12 in which the pressurized oil is supplied to the retard-side oil chamber 28 will be referred to as a "retard region" hereinbelow.

Figure 2:
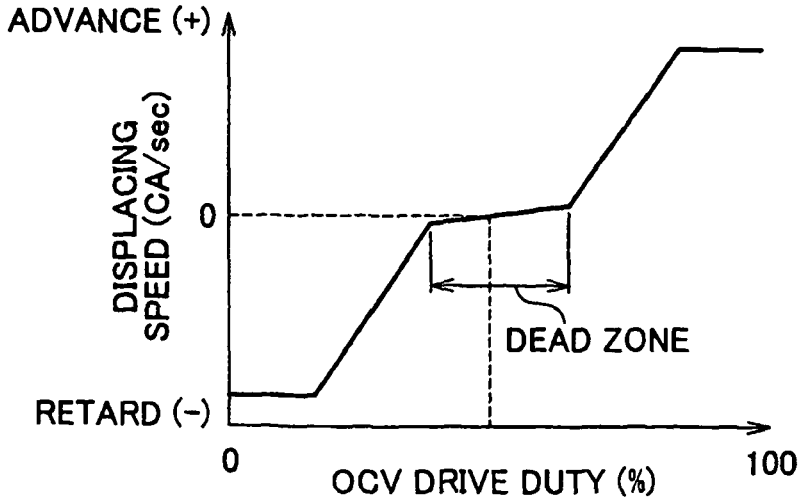
FIG. 2 is a graph that depicts the relationship between an oil control valve drive duty and a displacement speed of a hydraulic actuator in a variable valve timing mechanism.

FIG. 2 is a characteristic diagram representing the relationship between the OCV drive duty and the displacement speed of the hydraulic actuator 20 (the changing speed of the cam shaft displacement angle relative to the crank shaft) in the variable valve timing mechanism. As illustrated in this figure, with the variable valve timing mechanism, a dead zone in which the displacement speed is changed just a small amount against the change in a duty value, i.e., in which the responsiveness to the change in a duty value remains low, exists near a duty by which the displacement speed of the hydraulic actuator 20 is kept zero (hereinafter, referred to as a "holding duty"). The neutral region described above is formed into a specified width. The dead zone refers to an extent of the OCV drive duty over which the spool 12 stays in the neutral region.

If the OCV drive duty is increased to above the dead zone, the displacement speed of the hydraulic actuator 20 begins to increase toward the advance side and changes linearly in response to changes in the OCV drive duty. This occurs as the operation region of the spool 12 shifts from the neutral region to the advance region. At the moment when the OCV drive duty is increased to a prescribed level, the displacement speed of the hydraulic actuator 20 reaches a maximum advance speed. Even if the OCV drive duty is increased to above the prescribed level, the displacement speed of the hydraulic actuator 20 remains constant. At this time, the spool 12 moves to a limit position in the advance region, allowing the A-port to fully communicate with the P-port and also bringing the B-port into full communication with the R-port.

In contrast, if the OCV drive duty is decreased to below the dead zone, the displacement speed of the hydraulic actuator 20 begins to increase toward the retard side and changes linearly in response to changes in the OCV drive duty. This occurs as the operation region of the spool 12 shifts from the neutral region to the retard region. At the moment when the OCV drive duty decreases to a prescribed level, the displacement speed of the hydraulic actuator 20 reaches a maximum retard speed. Even if the OCV drive duty is decreased below the prescribed level, the displacement speed of the hydraulic actuator 20 remains constant. At this time, the spool 12 is moved to a limit position in the retard region, allowing the A-port to fully communicate with the R-port and also bringing the B-port into full communication with the P-port.

A control unit 40 controls the OCV 10. The control unit 40 cooperates with the mechanical parts, including the hydraulic actuator 20 and the OCV 10 (the variable valve timing mechanism), to form a variable valve-timing device. The control unit 40 sets a target displacement angle of the cam shaft relative to the crank shaft and calculates an OCV drive duty based on the deviation between the actual displacement angle (controlled displacement angle) and the target displacement angle. The control unit 40 feeds the calculated OCV drive duty to the OCV 10 as a control signal. The target displacement angle refers to a displacement angle at which optimum valve timing is obtained depending on the operating state of an engine. The target displacement angle is determined using a map that is based on the engine operating state. The controlled displacement angle may be calculated from an output signal of a crank angle sensor 42 and an output signal of a cam angle sensor 44.

Hereinafter, the control of the OCV 10 executed by the control unit 40 will be described with reference to FIGS. 3 and 4. Control characteristics of the hydraulic actuator 20 realized in case of using a virtual model control valve (referred to as a virtual OCV" hereinbelow) as the OCV are stored in the control unit 40 as model control characteristics. The relationship between the OCV drive duty and the displacement speed of the hydraulic actuator 20 is not fixed in the model control characteristics but, instead, the changing tendency of the displacement speed of the hydraulic actuator 20 with respect to the change in the OCV drive duty when the center of the dead zone (referred to as an "OCV center" hereinbelow) is taken as a reference point is set in the model control characteristics. More specifically, a characteristic curve as illustrated in the lower part of FIG. 3 is stored as the model control characteristics.

Figure 3:
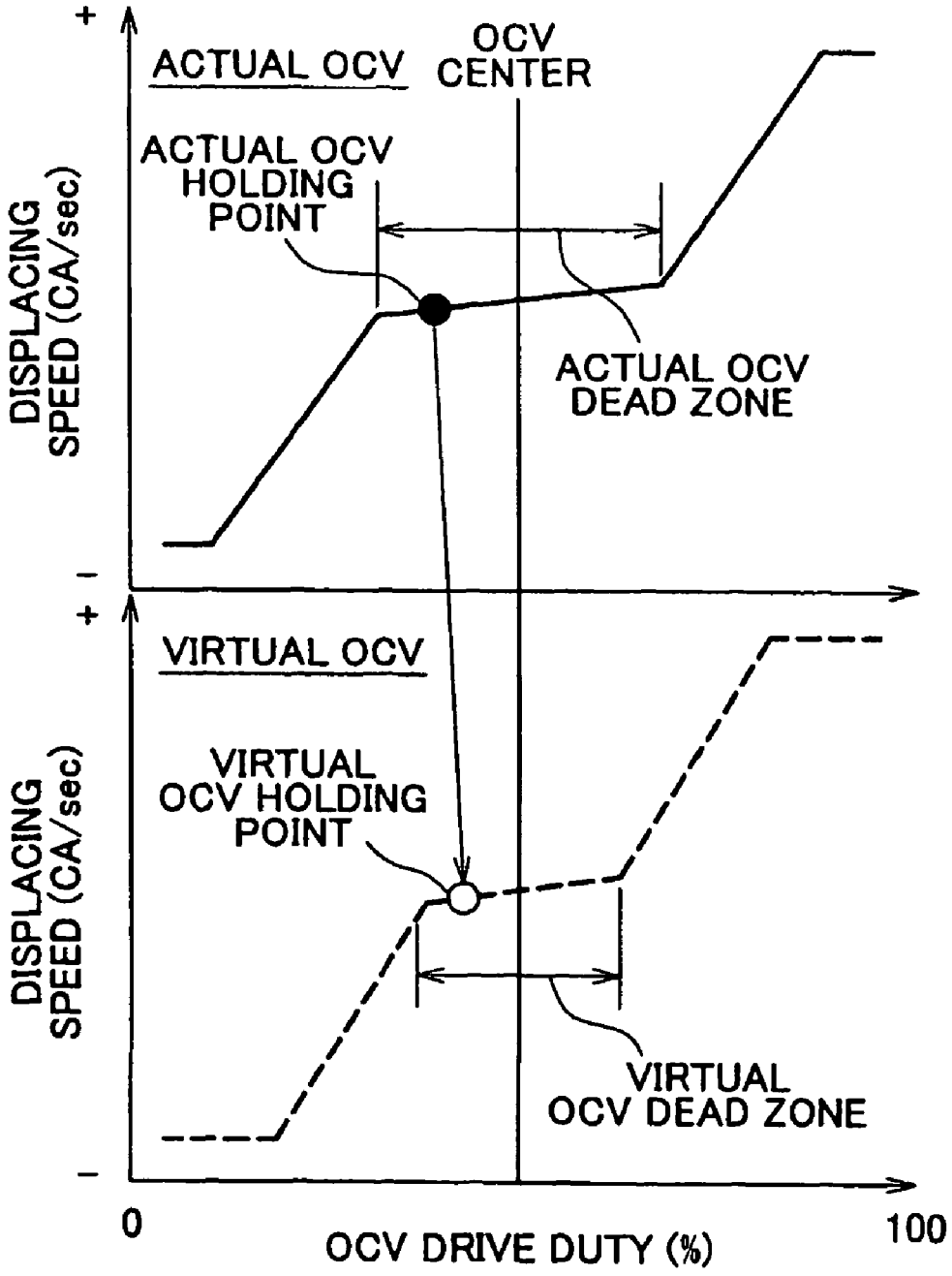
FIG. 3 is a graph that depicts the oil control valve control in accordance with the first embodiment of the present invention.

Illustrated in the upper part of FIG. 3 is a characteristic curve showing the control characteristics of the OCV 10. The control characteristics of the actual OCV 10 differ from OCV to OCV and also vary with the oil temperature or other conditions. This means that it is difficult to pre-set the control characteristics of the actual OCV 10. For this reason, the control unit 40 is designed to use the model control characteristics to estimate the control characteristics of the actual OCV 10 from minimum data on the control characteristics.

The control unit 40 determines the dead zone and sets a holding duty of the OCV 10 as the minimum data on the control characteristics. In other words, the control unit 40 functions as the "dead zone determining unit" and the "holding value setting unit" of the invention.

The dead zone of the OCV 10 is learned while the operation of the hydraulic actuator 20 is controlled by duty control of the OCV 10. The dead zone learning method performed by the control unit 40 will be described later. The dead zone learning method employed in the present embodiment is not particularly limited but may be any method proposed in the art. As one example, it may be possible to use a learning method by which the absolute value of a displacement speed of the hydraulic actuator 20 is calculated and, when the present value exceeds a prescribed reference value, the OCV drive duty at that time is learned as an upper or a lower end value of the dead zone. As another example, there is a learning method by which the maximum value of an OCV drive duty in a range where the absolute value of a displacement speed of the hydraulic actuator 20 is equal to or smaller than a prescribed reference value is learned as an upper end value of the dead zone and the minimum value of the OCV drive duty in that range is learned as a lower end value of the dead zone.

Because the dead zone of the virtual OCV is already known as the model dead zone, it is possible to calculate the ratio of the actual OCV dead zone width to an virtual OCV dead zone width if the dead zone of the OCV 10 (the actual OCV dead zone) is specified. This ratio is a correspondence coefficient for causing the OCV 10 and the virtual OCV to correspond to each other and may be used as a coefficient to correct variations in the control characteristics of the actual OCV 10 with respect to those of the virtual OCV. In this specification, the ratio of the actual OCV dead zone width to the virtual OCV dead zone width denotes an OCV variation correction coefficient which is defined by equation (1):

$$\text{OCV Variation Correction Coefficient} = \text{Actual OCV Dead Zone Width}/\text{Virtual OCV Dead Zone Width} \quad (1).$$

The holding duty of the OCV 10 is learned while the operation of the hydraulic actuator 20 is controlled by duty control of the OCV 10. The holding duty learning method employed in the present embodiment is not particularly limited but may be any appropriate method. As one example, when the controlled displacement angle shows no change for more than a prescribed time with the target displacement angle kept unchanged for more than a prescribed time, the OCV drive duty at that time may be learned as the holding duty.

If the holding duty of the OCV 10 is specified by learning, it is possible to find a deviation of the holding duty from the OCV center. In this regard, it is assumed that the deviation of the holding duty of the actual OCV 10 from the OCV center is proportional to the deviation of the holding duty of the virtual OCV from the OCV center. It is also assumed that the OCV center of the actual OCV 10 coincides with the OCV center of the virtual OCV. Under these conditions, the holding duty of the virtual OCV is defined by a virtual OCV holding duty learning value which is calculated using equation (2):

$$\text{Virtual OCV Holding Duty Learning Value} = (\text{Holding Duty Learning Value} - \text{OCV Center Value})/\text{OCV Variation Correction Coefficient} + \text{OCV Center Value} \quad (2).$$

The control unit 40 executes the duty control of the OCV 10 by conducting feedback control based on the deviation between the controlled displacement angle of the hydraulic actuator 20 and the target displacement angle. PD control is utilized in the feedback control. The relationship between an engine speed and a control gain and the relationship between an oil temperature and the control gain are pre-stored in the control unit 40 as map data. In the PD control consisting of P control and D control, the control amount of the P control is calculated from a deviation between the controlled displacement angle and the target displacement angle and also from a P control gain. Furthermore, the control amount of the D control is calculated from a changing speed in the deviation between the controlled displacement angle and the target displacement angle and also from a D control gain. Hereinafter, the P control amount and the D control amount in the virtual OCV will be collectively referred to as a basic control amount. The control unit 40 calculates a deviation-dependent basic control amount using the map data and adds the same to the virtual OCV holding duty learning value noted above. The added value constitutes an OCV drive duty which is to be output to the virtual OCV. Hereinafter, the OCV drive duty to be output to the virtual OCV will be referred to as a basic duty.

The basic duty is a duty that allows an optimum control result in the control characteristics of the virtual OCV. In order to obtain an optimum control result in the actual OCV 10, the basic duty needs to be converted to a value suitable for the control characteristics of the actual OCV 10. At this time, it is also required to take into account the dead zone of the OCV 10. This is because the change in the displacement speed of the hydraulic actuator 20 relative to the change in the OCV drive duty varies greatly depending on whether the OCV drive duty falls inside or outside the dead zone.

Figure 4:
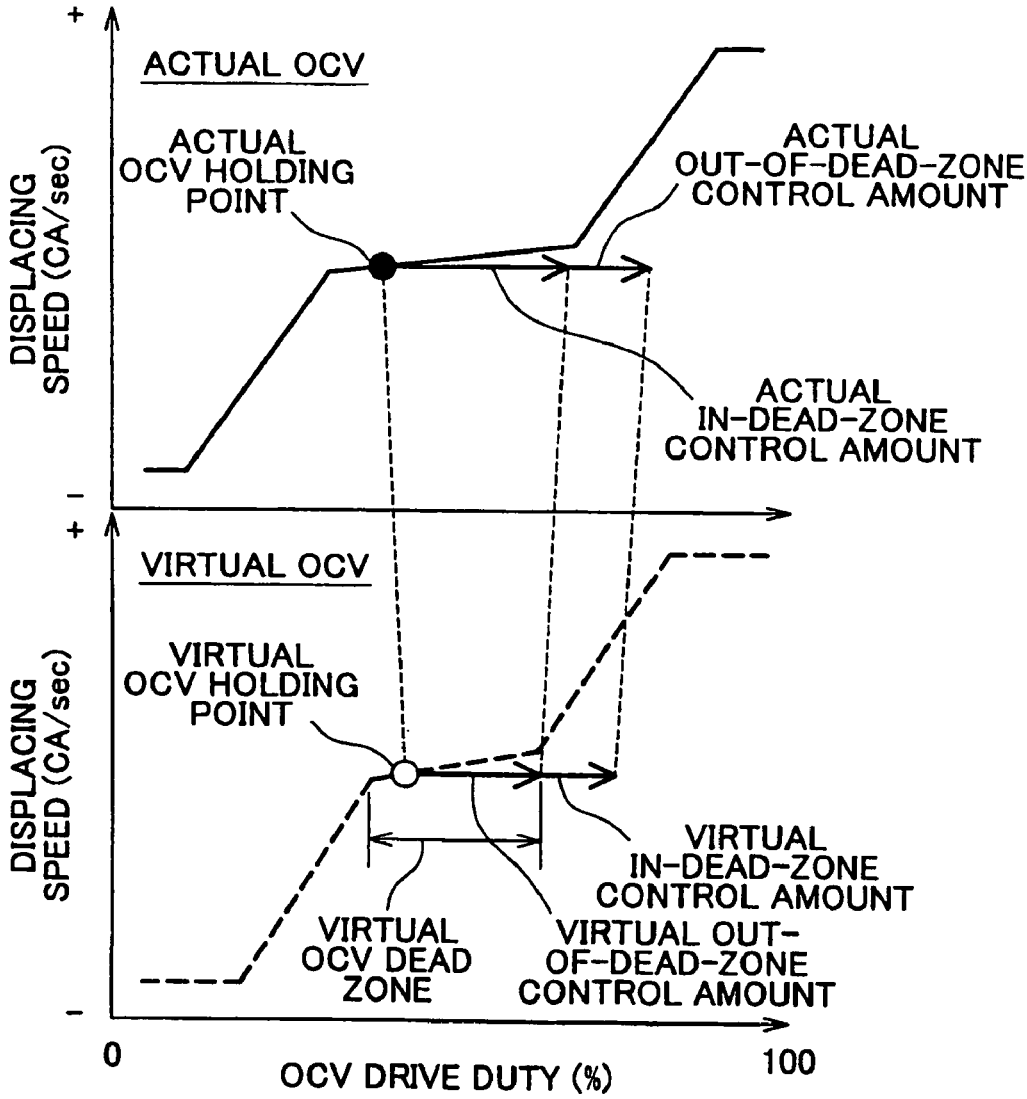
FIG. 4 is a graph that depicts the oil control valve control in accordance with the first embodiment of the present invention.
Figure 5:
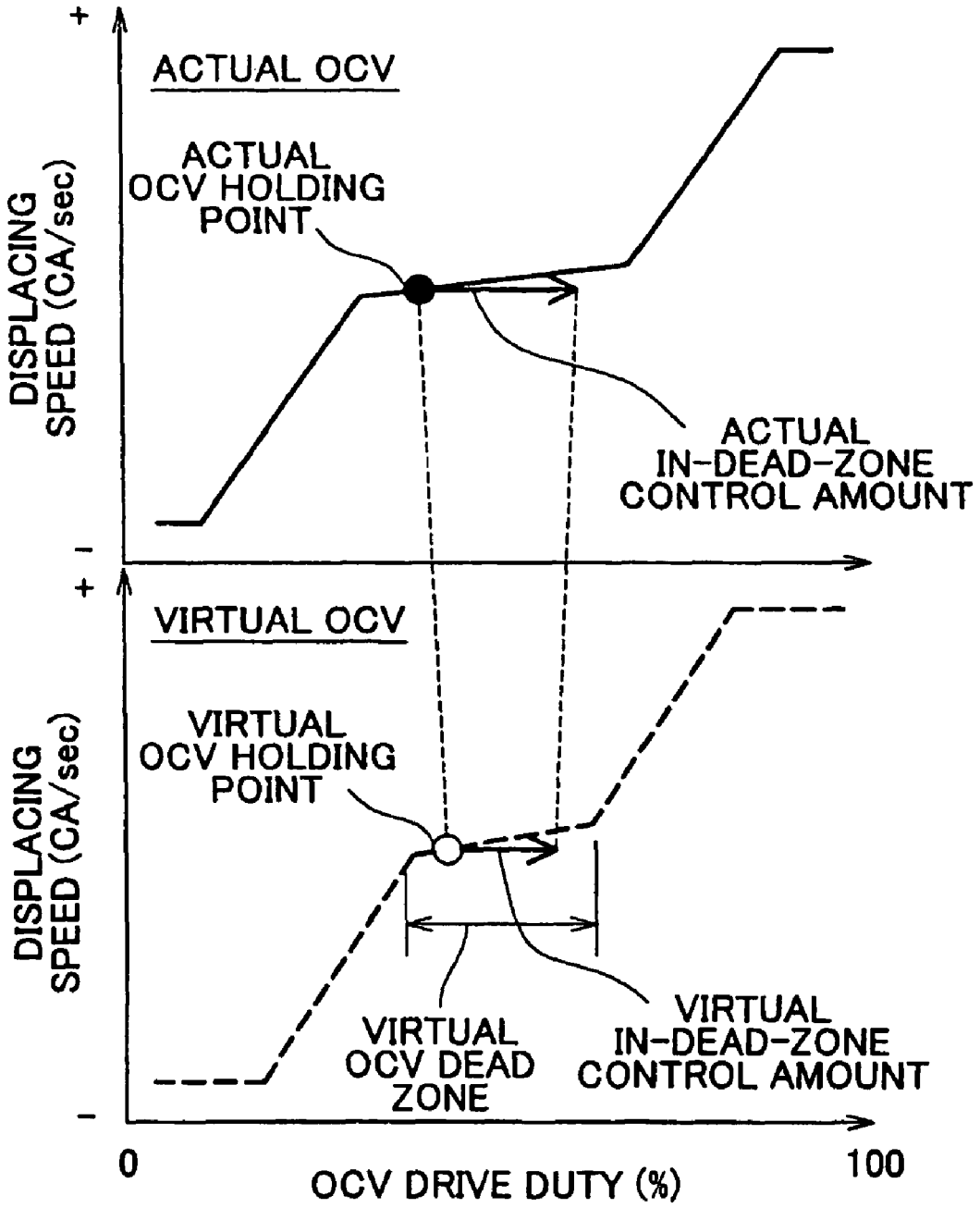
FIG. 5 is a graph that depicts the oil control valve control in accordance with the first embodiment of the present invention.

For this reason, as illustrated in the lower parts of FIGS. 4 and 5, the control unit 40 divides the basic control amount into a virtual OCV in-dead-zone control amount, which falls within the virtual OCV dead zone, and a virtual OCV out-of-dead-zone control amount, which falls outside the virtual OCV dead zone. FIG. 4 illustrates a case in which the basic duty falls outside the virtual OCV dead zone but FIG. 5 shows a case in which the basic duty falls within the virtual OCV dead zone. By separately converting the virtual OCV in-dead-zone control amount and the virtual OCV out-of-dead-zone control amount, the control unit 40 calculates an actual OCV in-dead-zone control amount from the virtual OCV in-dead-zone control amount and also calculates an actual OCV out-of-dead-zone control amount from the virtual OCV out-of-dead-zone control amount. The actual OCV in-dead-zone control amount and the actual OCV out-of-dead-zone control amount thus determined are added to the holding duty learning value. The added value becomes an OCV drive duty, which is output to the actual OCV 10. In other words, the OCV drive duty can be calculated using equation (3):

$$\text{OCV Drive Duty}=\text{Actual OCV In-dead-zone Control Amount}+\text{Actual OCV Out-of-dead-zone Control Amount}+\text{Holding Duty Learning Value} \quad (3).$$

By controlling the OCV 10 in the manner as noted above, it is possible to improve controllability of the hydraulic actuator 20, particularly controllability in a zone outside the dead zone of the OCV 10 while reducing the influence of variations in the control characteristics due to the individual difference of the OCV 10. Use of the model control characteristics of the virtual OCV as described above makes it possible to estimate the control characteristics of the actual OCV 10 merely by specifying the dead zone and the holding duty of the actual OCV 10. Therefore, the operation of the hydraulic actuator 20 may be controlled based on the control characteristics thus estimated.

Figure 6A:
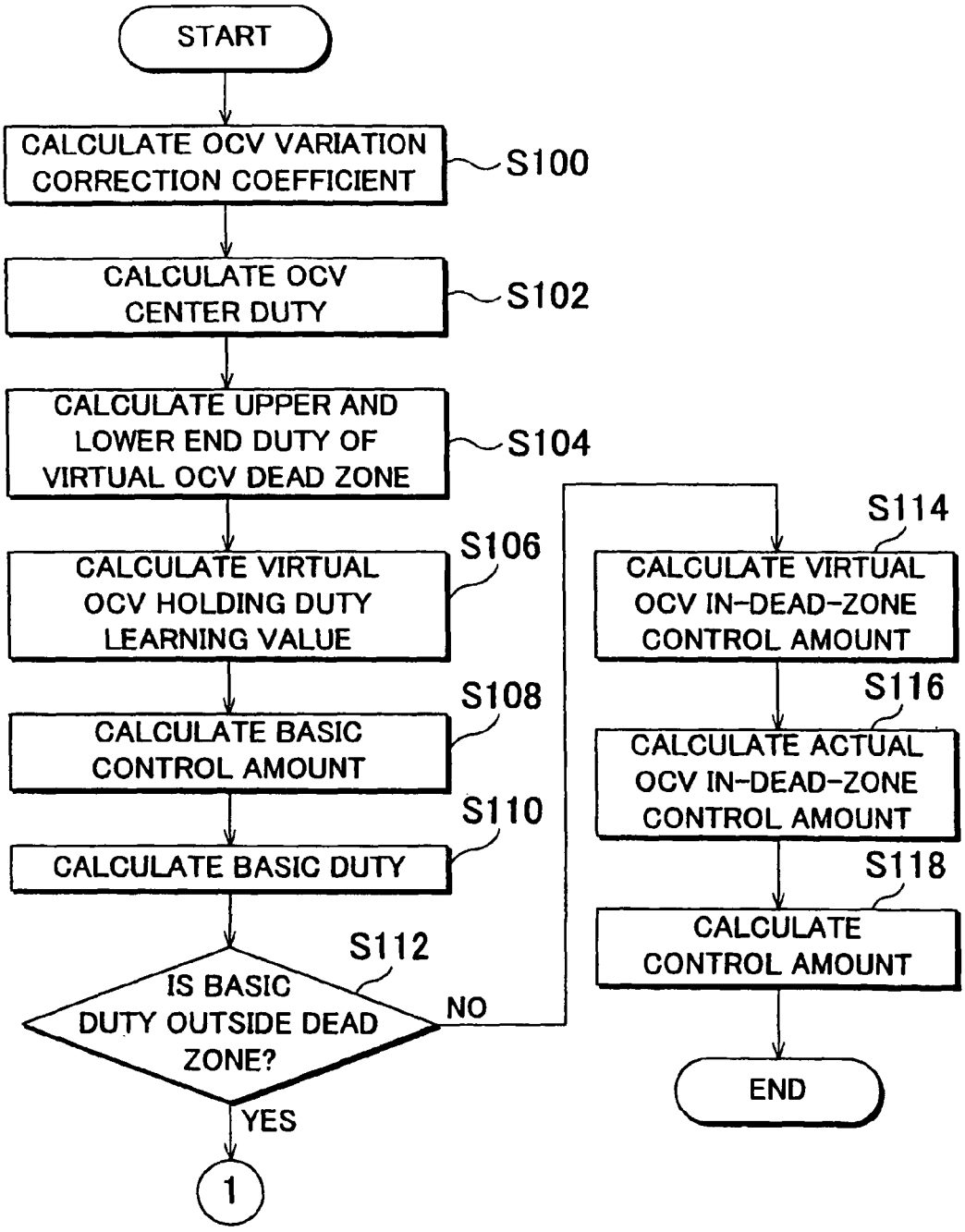
FIGS. 6A and 6B are a flowchart that illustrates the operation for calculating a control amount of an oil control valve, which is executed in the first embodiment of the present invention.
Figure 6B:
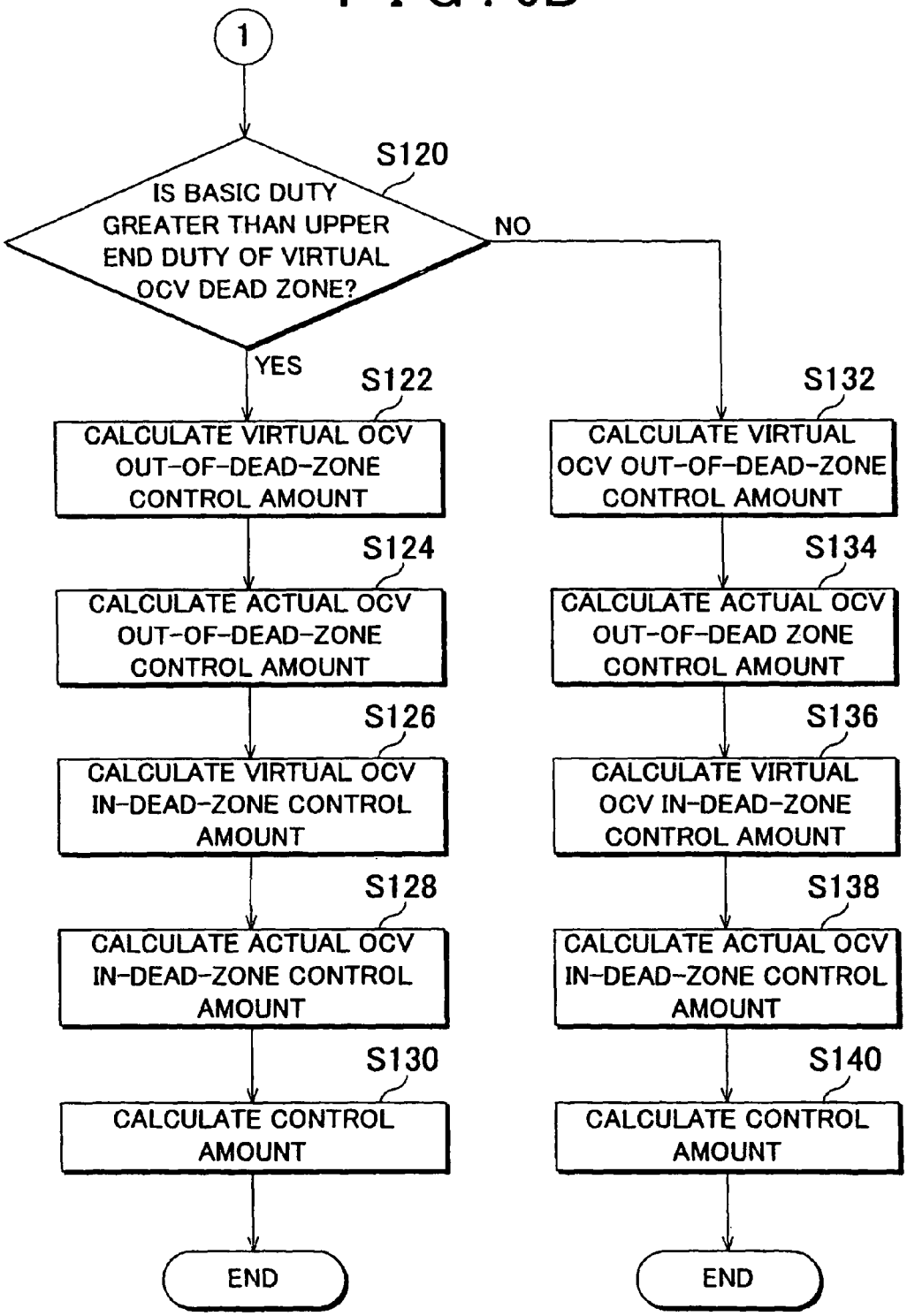

Hereinafter, the method of controlling the OCV 10 in accordance with the present embodiment will be described in more detail with reference to the flowcharts shown in FIGS. 6 to 10. First, the flowchart shown in FIGS. 6A and 6B illustrates an operation for calculating the control amount to be output to the OCV 10. This operation is periodically executed by the control unit 40.

In step S100 of the operation shown in FIG. 6A, an OCV variation correction coefficient is calculated using equation (1). An OCV center duty as a center value of the dead zone of the OCV 10 is calculated in step S102. The OCV center duty may be determined by averaging the learning value of the upper end duty of the dead zone and the learning value of the lower end duty of the dead zone.

An upper end duty and a lower end duty of the dead zone of the virtual OCV are calculated in step S104. The upper end duty of the dead zone of the virtual OCV is equal to a value obtained by adding one half of the dead zone width of the virtual OCV to the OCV center duty calculated in step S102. The lower end duty of the dead zone of the virtual OCV is equal to a value obtained by deducting one half of the dead zone width of the virtual OCV from the OCV center duty. In step S106, a holding duty learning value of the virtual OCV is calculated using equation (2).

In step S108, the basic control amount of the virtual OCV is calculated using a map based the engine speed and the oil temperature. The oil temperature may be determined using an oil temperature sensor 46 arranged in a hydraulic line that connects the oil pump 30 with the OCV 10. In step S110, the basic duty of the virtual OCV is calculated using equation (4):

$$\text{Basic Duty}=\text{Holding Duty Learning Value of Virtual OCV}+\text{Basic Control Amount} \quad (4).$$

In step S112, it is determined whether the basic duty calculated in step S110 falls outside the dead zone of the virtual OCV. If the basic duty falls inside the dead zone of the virtual OCV, a control amount is calculated in steps S114, S116 and S118.

First, in step S114, a virtual OCV in-dead-zone control amount is calculated using equation (5):

$$\text{Virtual OCV In-dead-zone Control Amount}=\text{Basic Duty}-\text{Virtual OCV Holding Duty Learning Value} \quad (5).$$

Next, in step S116, the virtual OCV in-dead-zone control amount is converted to an actual OCV in-dead-zone control amount using equation (6):

$$\text{Actual OCV In-dead-zone Control Amount}=\text{Virtual OCV In-dead-zone Control Amount}\times\text{OCV Variation Correction Coefficient} \quad (6).$$

Finally, in step S118, the actual OCV in-dead-zone control amount calculated in step S116 is set as the control amount, which is determined using equation (7):

$$\text{Control Amount}=\text{Actual OCV In-dead-zone Control Amount} \quad (7).$$

If the determination made in step S112 reveals that the basic duty calculated in step S110 falls outside the dead zone of the virtual OCV, the operation proceeds to step S120. In step S120, it is determined whether the basic duty calculated in step S110 exceeds the upper end duty of the virtual OCV dead zone. If the basic duty exceeds the upper end duty of the virtual OCV dead zone, a control amount is calculated in steps S122, S124, S126, S128 and S130.

First, in step S122, a virtual OCV out-of-dead-zone control amount is calculated using equation (8):

$$\text{Virtual OCV Out-of-dead-zone Control Amount}=\text{Basic Duty}-\text{Upper End Duty of Virtual OCV Dead Zone} \quad (8).$$

Next, in step S124, the virtual OCV out-of-dead-zone control amount is converted to an actual OCV out-of-dead-zone control amount using equation (9):

$$\text{Actual OCV Out-of-dead-zone Control Amount}=\text{Virtual OCV Out-of-dead-zone Control Amount}\times\text{Temperature Correction Coefficient} \quad (9).$$

In equation (9), the temperature correction coefficient is set according to the temperature of the pressurized oil that affects the displacement speed of the hydraulic actuator 20.

In step S126, a virtual OCV in-dead-zone control amount is calculated using equation (10):

Virtual OCV In-dead-zone Control Amount=Upper End Duty of Virtual OCV Dead Zone−Virtual OCV Holding Duty Learning Value (10).

In step S128, the virtual OCV in-dead-zone control amount is converted to an actual OCV in-dead-zone control amount using equation (6).

Finally, in step S130, the actual OCV out-of-dead-zone control amount calculated in step S124 and the actual OCV in-dead-zone control amount calculated in step S128 are used to calculate a control amount using equation (11):

Control Amount=Actual OCV In-dead-zone Control Amount+Actual OCV Out-of-dead-zone Control Amount (11).

If the determination made in step S120 indicates that the basic duty calculated in step S110 is smaller than the upper end duty of the virtual OCV dead zone, then a control amount is calculated in steps S132, S134, S136, S138 and S140.

First, in step S132, a virtual OCV out-of-dead-zone control amount is calculated using equation (12):

Virtual OCV Out-of-dead-zone Control Amount=Basic Duty−Lower End Duty of Virtual OCV Dead Zone (12).

In step S134, the virtual OCV out-of-dead-zone control amount is converted to an actual OCV out-of-dead-zone control amount using equation (9).

In step S136, a virtual OCV in-dead-zone control amount is calculated using equation (13):

virtual OCV In-dead-zone Control Amount=Lower End Duty of virtual OCV Dead Zone−virtual OCV Holding Duty Learning Value (13).

In step S138, the virtual OCV In-dead-zone control amount is converted to an actual OCV In-dead-zone control amount using equation (6).

Finally, in step S140, the actual OCV out-of-dead-zone control amount calculated in step S134 and the actual OCV in-dead-zone control amount calculated in step S138 are used to calculate a control amount using equation (II).

In the present embodiment, the "correspondence coefficient calculating unit" of the invention may be implemented by executing step S100 in the control unit 40. The "model holding value calculating unit" of the invention may be implemented by executing step S106 in the control unit 40. The "model control amount calculating unit" of the invention may be implemented by executing step S108 in the control unit 40. The "in-dead-zone control amount calculating unit" of the invention may be implemented by executing steps S114 and S116, steps S126 and S128 or steps S136 and S138 in the control unit 40. The "out-of-dead-zone control amount calculating unit" of the invention may be implemented by executing steps S122 and S124 or steps S132 and S134 in the control unit 40. The "control signal setting unit" of the invention may be implemented by executing steps S118, S130 or S140 in the control unit 40.

Figure 7A:
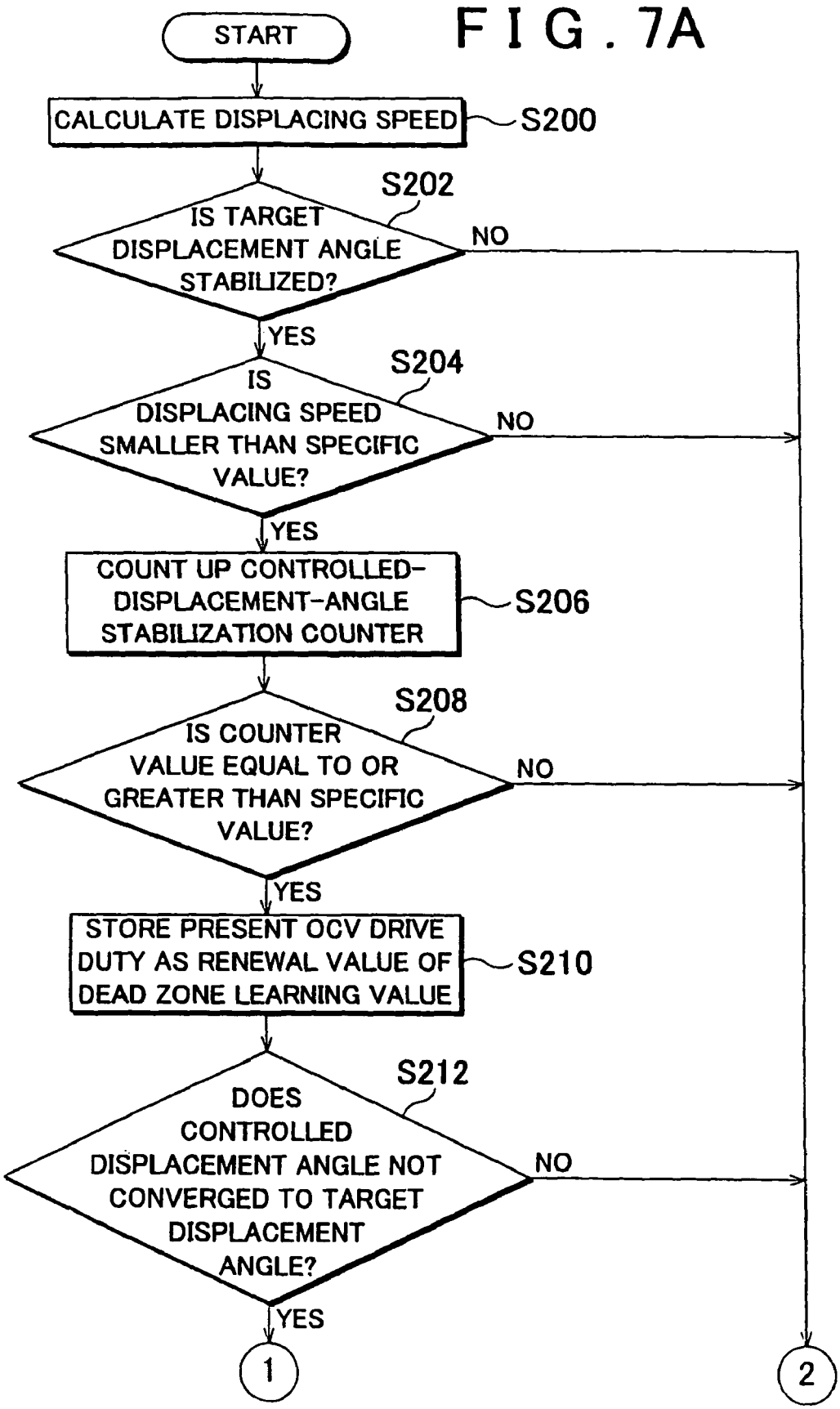
FIGS. 7A and 7B are a flowchart that illustrates the operation for learning an upper end duty and a lower end duty of a dead zone, which is executed in the first embodiment of the present invention.
Figure 7B:
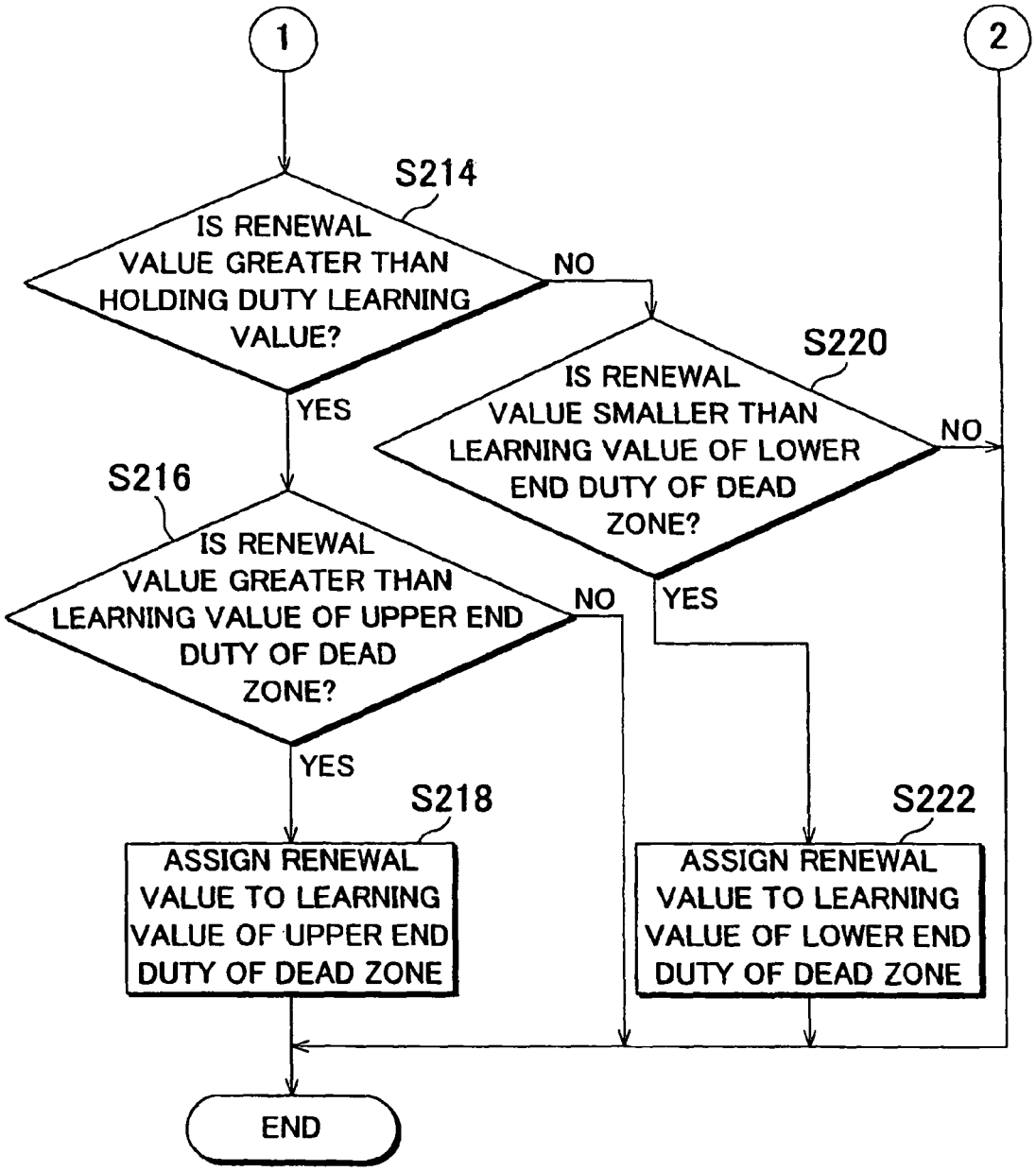

The flowcharts shown in FIGS. 7 to 10 and described next illustrate operations for learning the dead zone of the OCV 10. The dead zone of the OCV 10 is learned by each of these operations. The flowchart shown in FIGS. 7A and 7B illustrates an operation for learning the upper and the lower end duty of the dead zone of the OCV 10. In the present embodiment, the "dead zone determining unit" of the invention may be implemented by having the control unit 40 execute the operation shown in FIGS. 7A and 7B. The control unit 40 is periodically executes this operation.

In step S200 of the operation shown in FIG. 7A, the displacement speed of the hydraulic actuator 20 is calculated using equation (14):

Displacement Speed=Previous Value of Controlled Displacement Angle−Present Value of Controlled Displacement Angle (14).

In step S202, it is determined whether the target displacement angle of the hydraulic actuator 20 has been stabilized. The target displacement angle is determined based on the engine operating state, including factors such as, for example, the engine speed and the engine load. If the amount of change in the target displacement angle within a given time period is below a prescribed value, it is determined that the target displacement angle has been stabilized. The present operation ends if it is determined that the target displacement angle has not been stabilized.

If it is determined in step S202 that the target displacement angle has been stabilized, the operation proceeds to step S204. In step S204, it is determined whether the displacement speed is below a prescribed value. If the displacement speed is equal to or above the prescribed value, the present operation ends.

If it is determined in step S204 that the displacement speed is smaller than the prescribed value, the operation proceeds to step S206 where a controlled-displacement-angle stabilization counter is counted. The counter is reset when the condition of step S202 or S204 is not satisfied. In step S208, it is determined whether the controlled-displacement-angle stabilization counter shows a counted value equal to or greater than a prescribed value. If the counted value is below the prescribed value, the present operation ends.

If it is determined in step S208 that the counted value is equal to or greater than the prescribed value, i.e., if the displacement speed remains below the prescribed value for a given time period, the operation proceeds to step S210 where the OCV drive duty at the present time is temporarily stored in a memory as an updated value of the dead zone learning value. The updated value stored in the memory is updated by a new value each time step S210 is executed.

In step S212, it is determined whether the controlled displacement angle has converged to the target displacement angle. If a deviation between the controlled displacement angle and the target displacement angle remains equal to or below a prescribed reference deviation longer than a given time period, it can be determined that the controlled displacement angle has converged to the target displacement angle. If the controlled displacement angle has converged to the target displacement angle, it may be determined that the learning values of the upper and the lower end duty of the present dead zone are proper. The present operation ends if such is the case. Alternatively, step S212 may be executed before steps S204 to S210.

If it is determined in step S212 that the controlled displacement angle has not converged to the target displacement angle, the operation proceeds to step S214 where it is determined whether the updated value stored in the memory exceeds the holding duty learning value. If the updated value exceeds the holding duty learning value, the operation proceeds to step S216. If the updated value is equal to or below the holding duty learning value, the operation proceeds to step S220.

In step S216, it is determined whether the updated value stored in the memory exceeds the present learning value of the upper end duty of the dead zone. If the updated value is equal to or smaller than the present learning value, the present operation ends. In contrast, if the updated value exceeds the present learning value, the operation proceeds to step S218 where the updated value stored in the memory is set as the learning value of the upper end duty of the dead zone. That is, the upper end duty of the dead zone is updated.

In step S220, it is determined whether the updated value stored in the memory is smaller than the present learning value of the lower end duty of the dead zone. If the updated value is equal to or greater than the present learning value, the present operation ends. In contrast, if the updated value is below the present learning value, the operation proceeds to step S222 where the updated value stored in the memory is set as the learning value of the lower end duty of the dead zone. That is, the lower end duty of the dead zone is updated.

Figure 8:
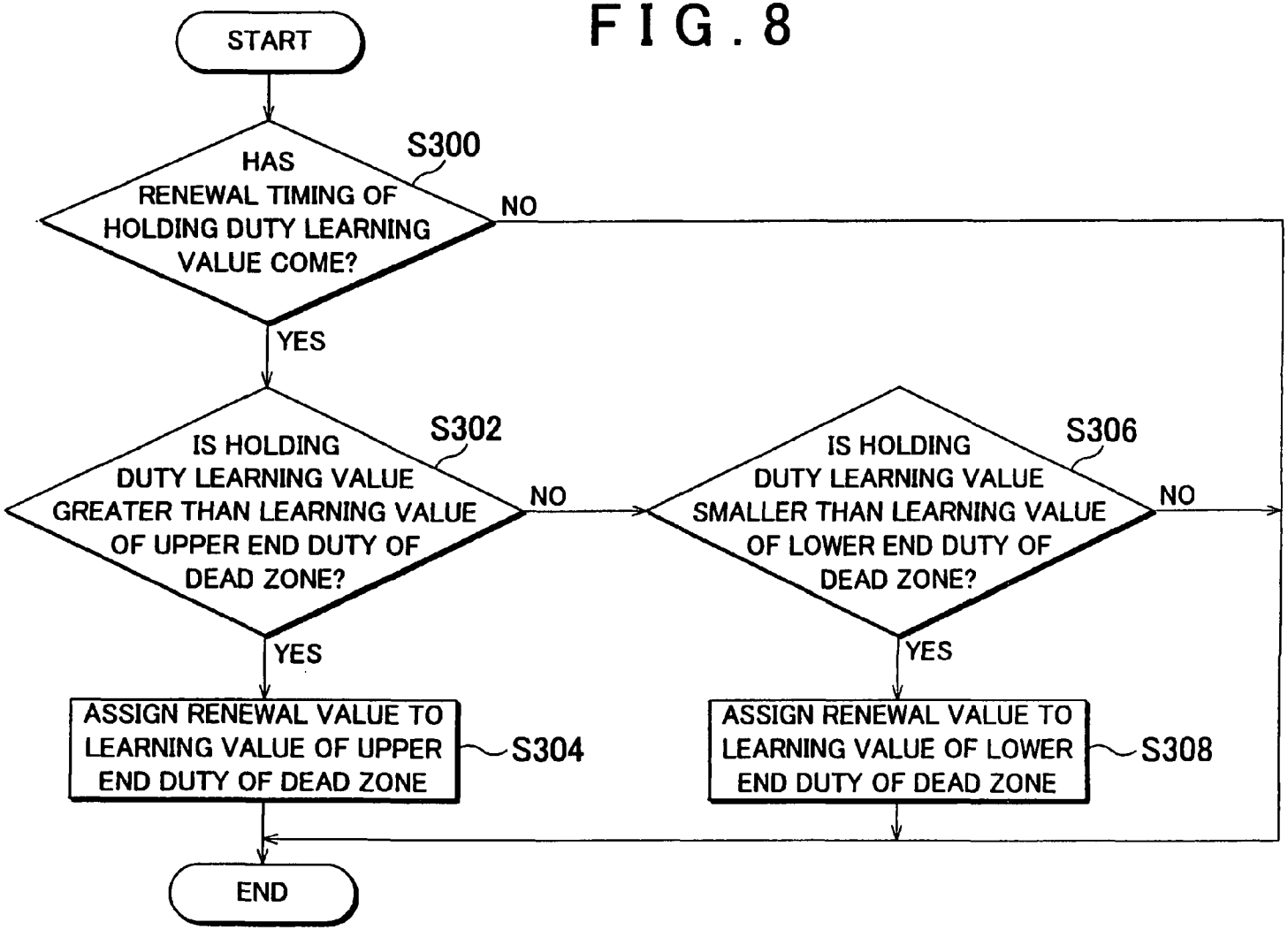
FIG. 8 is a flowchart that illustrates the operation for learning an upper end duty and a lower end duty of a dead zone, which is executed in the first embodiment of the present invention.

The flowchart shown in FIG. 8 illustrates an operation for learning the upper and the lower end duty of the dead zone of the OCV 10. In the present embodiment, the "dead zone determining unit" of the invention may also be implemented by executing the operation shown in FIG. 8 with the control unit 40. The control unit 40 periodically executes this operation.

In step S300 of the operation shown in FIG. 8, it is determined whether it is time to update the holding duty learning value. The holding duty learning value is periodically updated a different operation. The renewal period of the holding duty learning value is set longer than the execution period of the present operation. If it is not yet time to update the holding duty learning value, the present operation ends.

If it is determined in step S300 that it is time to update the holding duty learning value, the operation proceeds to step S302 where it is determined whether the updated value of the holding duty learning value exceeds the present learning value of the upper end duty of the dead zone. If the updated value of the holding duty learning value exceeds than the present learning value of the upper end duty of the dead zone, the operation proceeds to step S304 where the updated value of the holding duty learning value is set as the present learning value of the upper end duty of the dead zone. That is, the upper end duty of the dead zone is updated.

In contrast, if the updated value of the holding duty learning value is equal to or smaller than the present learning value of the upper end duty of the dead zone, the operation proceeds to step S306 where it is determined whether the updated value of the holding duty learning value is smaller than the present learning value of the lower end duty of the dead zone. If the updated value of the holding duty learning value is smaller than the present learning value of the lower end duty of the dead zone, the operation proceeds to step S308 where the updated value of the holding duty learning value is set as the learning value of the lower end duty of the dead zone. That is, the lower end duty of the dead zone is updated.

Figure 9:
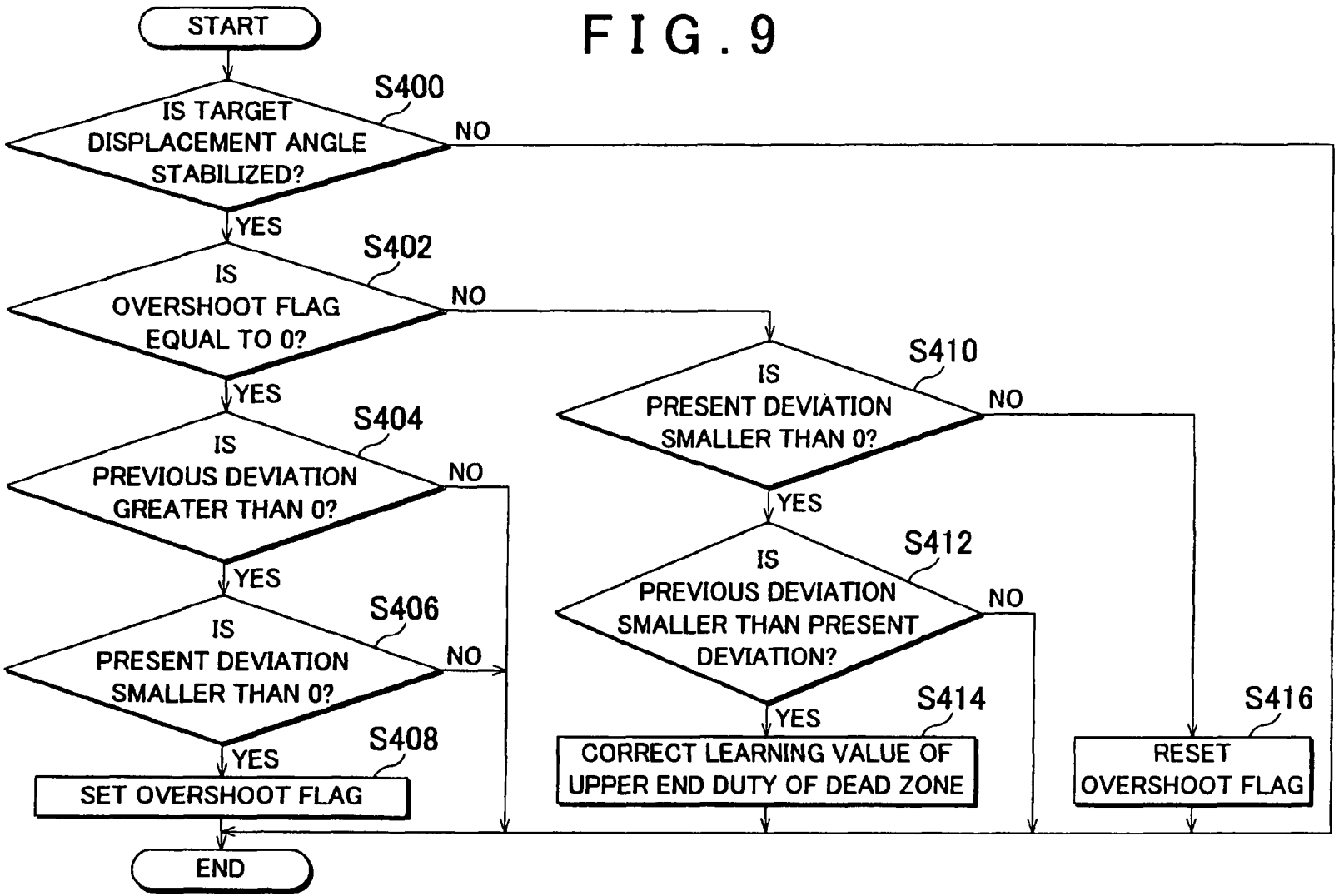
FIG. 9 is a flowchart that illustrates the operation for learning an upper end duty of a dead zone, which is executed in the first embodiment of the present invention.

The flowchart shown in FIG. 9 illustrates an operation for learning the upper end duty of the dead zone of the OCV 10. The control unit 40 periodically executes this operation.

In step S400 of the operation shown in FIG. 9, it is determined whether the target displacement angle of the hydraulic actuator 20 has been stabilized. The target displacement angle is determined based on the engine operating state, including factors such as, for example, the engine speed and the engine load. If there is no change in the target displacement angle for more than a given time period, it is determined that the target displacement angle has been stabilized. The present operation ends if the target displacement angle has not yet been stabilized.

If it is determined in step S400 that the target displacement angle has been stabilized, the operation proceeds to step S402. In step S402, it is determined whether an overshoot flag is equal to zero. The term "overshoot flag" refers to a flag that is set when the respective conditions of steps S404 and S406 described below are satisfied.

If it is determined in step S402 that the overshoot flag is equal to zero, the operation proceeds to step S404 where it is determined whether the previous deviation between the target displacement angle and the controlled displacement angle is greater than zero. If the previous deviation is equal to or smaller than zero, the present operation ends.

If it is determined in step S404 that the previous deviation is greater than zero, i.e., if it is determined that the controlled displacement angle failed to reach the target displacement angle at the previous time, the operation proceeds to step S406 where it is determined whether the present deviation between the target displacement angle and the controlled displacement angle is smaller than zero. If the present deviation is equal to or greater than zero, the present operation ends.

If it is determined in step S406 that the present deviation is smaller than zero, i.e., if the controlled displacement angle is overshot beyond the target displacement angle, the operation proceeds to step S408, where the overshoot flag is set to 1.

If it is determined in step S402 that the overshoot flag is not equal to zero, the operation proceeds to step S410 where it is determined whether the present deviation between the target displacement angle and the controlled displacement angle is smaller than zero. If the present deviation is equal to or greater than zero, i.e., if the controlled displacement angle became equal to or smaller than the target displacement angle once again, the operation proceeds to step S416 where the overshoot flag is reset to 0.

If it is determined in step S410 that the present deviation is smaller than zero, i.e., if the controlled displacement angle is overshot beyond the target displacement angle even at this time, the operation proceeds to step S412 where it is determined whether the previous deviation is below the present deviation. If the present deviation is equal to or smaller than the previous one, it can be determined that the overshoot amount of the controlled displacement angle with respect to the target displacement angle is still increased. In this case, the present operation ends. In contrast, if the previous deviation is smaller than the present one, it can be determined that the overshoot amount is greatest at the previous time and further that the absolute value of the previous deviation is the maximum overshoot amount.

If it is determined in step S412 that the previous deviation is smaller than the present one, the operation proceeds to step S414 where the upper end duty learning value of the dead zone is corrected using equation (15):

$$\text{Upper End Duty Learning Value of Dead Zone} = \text{Upper End Duty Learning Value of Dead Zone} - \text{Correction Value} \quad (15).$$

The upper end duty learning value on the right side of equation (15) denotes a pre-correction value, while the upper end duty learning value on the left side is a post-correction value. The correction value appearing in the right side is decided by the maximum overshoot amount, which means that the greater the maximum overshoot amount, the greater the correction value.

With the operation shown in FIG. 9, the upper end duty learning value of the dead zone is corrected according to the overshoot amount to ensure that the controlled displacement angle of the hydraulic actuator 20 does not exceed the target displacement angle in a positive direction. This improves the controllability of the hydraulic actuator 20. In the present embodiment, the "dead zone determining unit" of the invention may be implemented by executing the operation shown in FIG. 9 with the control unit 40.

Figure 10:
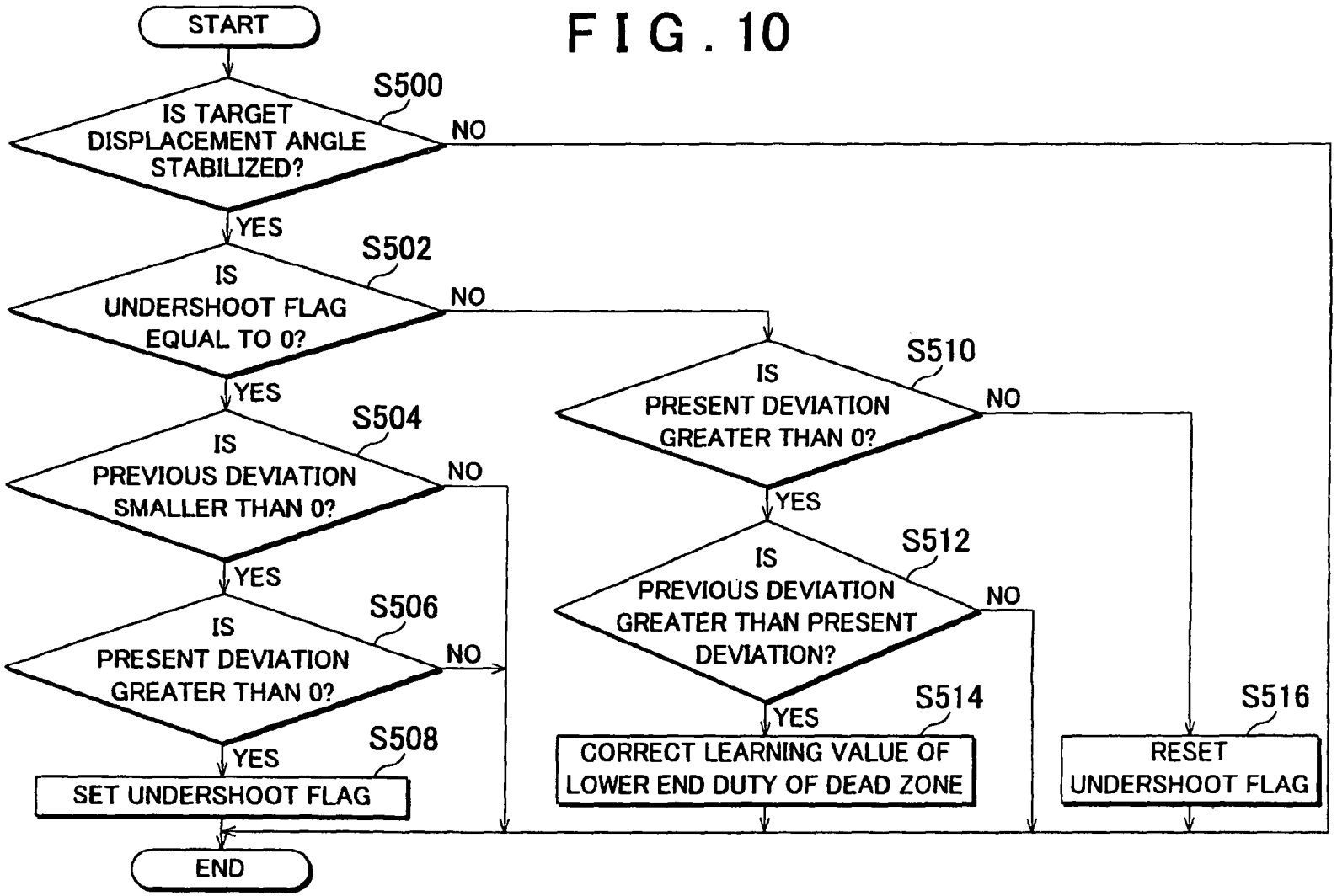
FIG. 10 is a flowchart that illustrates the operation for learning a lower end duty of a dead zone, which is executed in the first embodiment of the present invention.

The flowchart shown in FIG. 10 illustrates an operation for learning the lower end duty of the dead zone of the OCV 10. The control unit 40 periodically executes this operation.

In step S500 of the operation shown in FIG. 10, it is determined whether the target displacement angle of the hydraulic actuator 20 has been stabilized. The target displacement angle is determined based on the engine operating state, including factors such as, for example, the engine speed and the engine load. If there is no change in the target displacement angle for more than a given time, the target displacement angle is determined to have been stabilized. The present operation ends if the target displacement angle has not yet been stabilized.

If it is determined in step S500 that the target displacement angle has been stabilized, the operation proceeds to step S502. In step S502, it is determined whether an undershoot flag is equal to zero. The term "undershoot flag" refers to a flag that is set when the respective conditions of steps S504 and S506 described below are satisfied.

If it is determined in step S502 that the undershoot flag is equal to zero, the operation proceeds to step S504 where it is determined whether the previous deviation between the target displacement angle and the controlled displacement angle is smaller than zero. If the previous deviation is equal to or greater than zero, the present operation ends.

If it is determined in step S504 that the previous deviation is smaller than zero, i.e., if the controlled displacement angle failed to reach the target displacement angle at the previous time, the operation proceeds to step S506 where it is determined whether the present deviation between the target displacement angle and the controlled displacement angle is greater than zero. If the present deviation is equal to or smaller than zero, the present operation ends.

If it is determined in step S506 that the present deviation is greater than zero, i.e., if the controlled displacement angle is undershot beyond the target displacement angle, the operation proceeds to step S508 where the undershoot flag is set to 1.

If it is determined in step S502 that the undershoot flag is not equal to zero, the operation proceeds to step S510 where it is determined whether the present deviation between the target displacement angle and the controlled displacement angle is greater than zero. If the present deviation is equal to or smaller than zero, i.e., if the controlled displacement angle became equal to or greater than the target displacement angle once again, the operation proceeds to step S516 where the undershoot flag is reset to 0.

If it is determined in step S510 that the present deviation is greater than zero, i.e., if the controlled displacement angle is undershot beyond the target displacement angle even at this time, the operation proceeds to step S512 where it is determined whether the previous deviation is greater than the present one. If the present deviation is equal to or greater than the previous one, it is determined that the undershoot amount of the controlled displacement angle with respect to the target displacement angle is still increased. In this case, the present operation ends. In contrast, if the previous deviation is greater than the present one, it is determined that the undershoot amount was previously at a maximum and further that the absolute value of the previous deviation is the maximum undershoot amount.

If it is determined in step S512 that the previous deviation is greater than the present one, the operation proceeds to step S514 where the lower end duty learning value of the dead zone is corrected using equation (16):

$$\text{Lower End Duty Learning Value of Dead Zone} = \text{Lower End Duty Learning Value of Dead Zone} + \text{Correction Value} \quad (16).$$

The lower end duty learning value appearing in the right side of equation (16) denotes a pre-correction value, while the lower end duty learning value appearing in the left side is a post-correction value. The correction value appearing in the right side is determined based on the maximum undershoot amount, which means that the correction value is increased as the maximum undershoot amount increases.

With the operation shown in FIG. 10, the lower end duty learning value of the dead zone is corrected in accordance with the undershoot amount to ensure that the controlled displacement angle of the hydraulic actuator 20 does not exceed the target displacement angle in a negative direction. This improves the controllability of the hydraulic actuator 20. In the present embodiment, the "dead zone determining unit" of the invention may be implemented by executing the operation shown in FIG. 10 with the control unit 40.

Hereinafter, a second embodiment of the present invention will be described with reference to the accompanying drawings.

A hydraulic actuator control device as the second embodiment of the present invention is based on the configuration and control contents of the hydraulic actuator control device as the first embodiment but is characterized by adding new control contents, which are described below. In the present embodiment, the OCV variation correction coefficient changes in accordance with the absolute value of the deviation. As represented using equation (1) noted above, the OCV variation correction coefficient is defined by a ratio of the actual OCV dead zone width to the virtual OCV dead zone width. The term "deviation" refers to the deviation of the controlled displacement angle from the target displacement angle.

Figure 11:
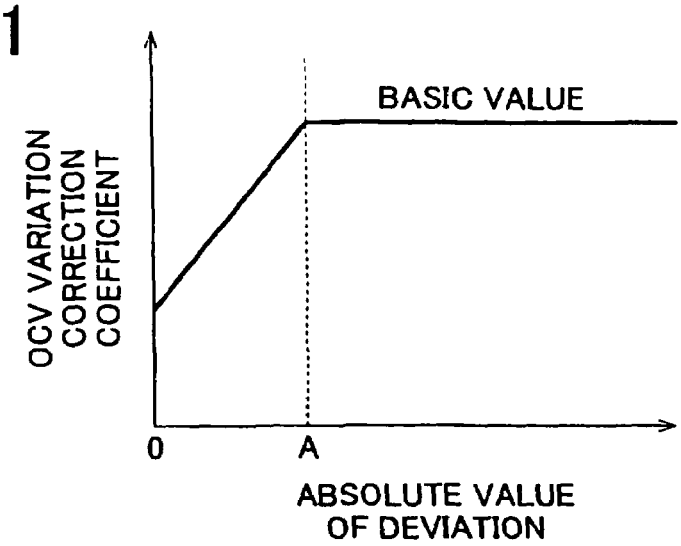
FIG. 11 is a view that illustrates the setting of an oil control valve variation correction coefficient employed in a second embodiment of the present invention.

FIG. 11 is a view illustrating the setting of the OCV variation correction coefficient employed in the present embodiment. In the present embodiment, as illustrated in FIG. 11, the value calculated using equation (1) is used as a basic value of the OCV variation correction coefficient. When the absolute value of the deviation is below a prescribed value "A", the OCV variation correction coefficient is corrected into a value smaller than the basic value as the absolute value of the deviation grows smaller. The following method may be employed as a concrete method for realizing the setting of the OCV variation correction coefficient as illustrated in FIG. 11. A coefficient is prepared that remains equal to 1 when the absolute value of the deviation exceeds the prescribed value "A" but decreases in proportion to the absolute value of the deviation when the absolute value of the deviation is equal to or smaller than the prescribed value "A". Then, the coefficient is multiplied by the OCV variation correction coefficient calculated using equation (1).

As represented by equation (5), the OCV variation correction coefficient is used to calculate the actual OCV in-dead-zone control amount. By reducing the OCV variation correction coefficient, it is possible to reduce the fluctuation in the actual OCV in-dead-zone control amount even when the virtual OCV in-dead-zone control amount changes. With the present embodiment, the fluctuation in the actual OCV in-dead-zone control amount may be suppressed after the controlled displacement angle of the hydraulic actuator 20 has converged to the target displacement angle. This makes it possible to stably maintain the controlled displacement angle of the hydraulic actuator 20 equal to the target displacement angle.

In the present embodiment, the "correspondence coefficient correcting unit" of the invention may be implemented by setting the OCV variation correction coefficient with the control unit 40 as illustrated in FIG. 11.

Hereinafter, a third embodiment of the present invention will be described with reference to the accompanying drawings.

Figure 12:
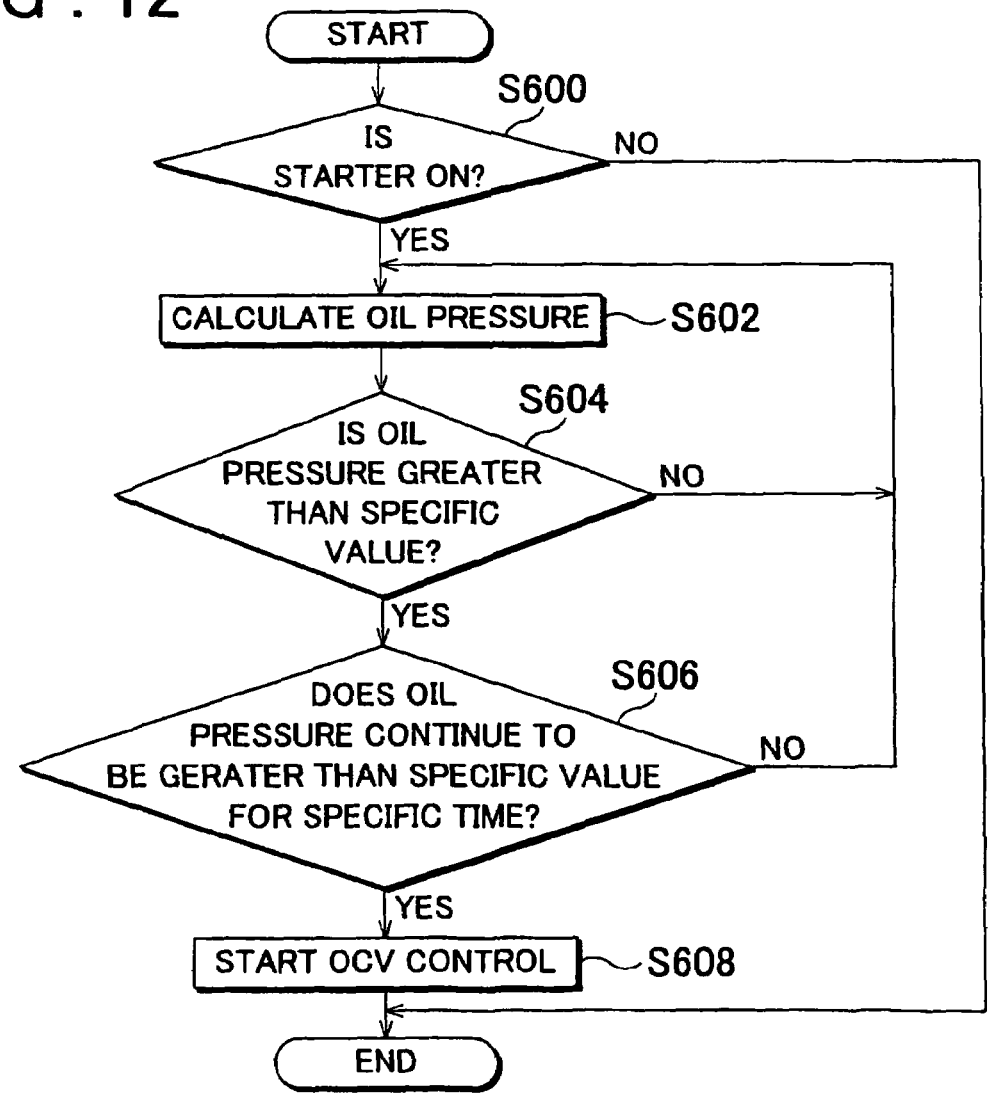
FIG. 12 is a flowchart that illustrates the operation for determining whether to execute the oil control valve control when the engine is started, which is executed in a third embodiment of the present invention.

A hydraulic actuator control device according to the third embodiment of the present invention further executes the control shown in FIG. 12. The flowchart shown in FIG. 12 illustrates an operation for determining initiation of the OCV control at the time of engine startup. This operation is periodically executed by the control unit 40.

When the engine is stopped, the spool 12 of the OCV 10 is biased by the spring 16 and remains in a retard-side end position within the sleeve 18, as a result of which the hydraulic actuator 20 remains inoperative, with the controlled displacement angle retarded greatest. At this time, the retard-side oil chamber 28 of the hydraulic actuator 20 is connected to the oil pump 30. Because the oil pump 30 remains inoperative while the engine is stopped, no pressurized oil is fed to the retard-side oil chamber 28 and no hydraulic pressure is exerted in the retard-side oil chamber 28.

If the OCV control is initiated in this state to operate the OCV 10 in the advance direction, the pressurized oil is supplied to the advance-side oil chamber 26. Because there exists no pressurized oil, which is to be discharged from the retard-side oil chamber 28, the rotor 24 pushed by the pressurized oil filled in the advance-side oil chamber 26 is rapidly rotated with no resistance and is suddenly collided with the housing 22. Collision of the rotor 24 with the housing 22 generates a noise that is likely to disturb the vehicle occupants.

The operation shown in FIG. 12 is executed to solve the above-noted problem posed during engine startup. In step S600, it is determined whether an engine starter is turned on. If the engine starter is turned off, i.e., if the engine is not being started, the present operation ends.

If it is determined in step S600 that the starter is turned on, the operation proceeds to step S602 where the pressure of the pressurized oil fed from the oil pump 30 is calculated. The oil pressure may be determined based on the rotational speed of the oil pump 30 and the amount of time that has elapsed since the oil pump began rotating. Alternatively, the oil pressure may be measured by a pressure sensor arranged in the discharge port of the oil pump 30.

In step S604, it is determined whether the oil pressure calculated in step S602 exceeds a prescribed value. Steps S602 and S604 are repeatedly executed until the oil pressure exceeds the prescribed value.

If it is determined in step S604 that the oil pressure exceeds the prescribed value, the operation proceeds to step S606. In step S606, it is determined whether a prescribed time has lapsed after the oil pressure exceeds the prescribed value. This is to allow the oil pressure within the retard-side oil chamber 28 grows sufficiently high. Steps S602, S604 and S606 are repeatedly performed until the prescribed time has elapsed. When the prescribed time has elapsed, the operation proceeds to step S608 to initiate the control of the OCV 10.

With the operation shown in FIG. 12, the operation of the hydraulic actuator 20 in the advance direction is inhibited until the oil pressure is increased sufficiently. Therefore, it is possible to avoid the generation of the striking noise. In the present embodiment, the "inhibiting unit" of the invention may be implemented by executing the operation shown in FIG. 12 with the control unit 40.

Hereinafter, a fourth embodiment of the present invention will be described with reference to the accompanying drawings.

A hydraulic actuator control device according to the fourth embodiment of the present invention is based on the configuration and control contents of the hydraulic actuator control device according to the first embodiment further includes new control contents which will be described below. In the present embodiment, the OCV drive duty is calculated using equation (17):

$$\text{OCV Drive Duty} = \text{Control Amount} + \text{Control Reference Duty} \quad (17).$$

The term "control amount" in equation (17) refers to a summed value of a P control amount and a D control amount and also refers to a summed value of the actual OCV in-dead-zone control amount and the actual OCV out-of-dead-zone control amount.

The term "control reference duty" in equation (17) refers to a control reference used in duty-controlling the OCV 10 and is calculated using equation (18):

$$\text{Control Reference Duty} = (\text{OCV Center Duty} - \text{Holding Duty Learning Value}) \times \text{Correction Coefficient} + \text{Holding Duty Learning Value} \quad (18)$$

Figure 13:
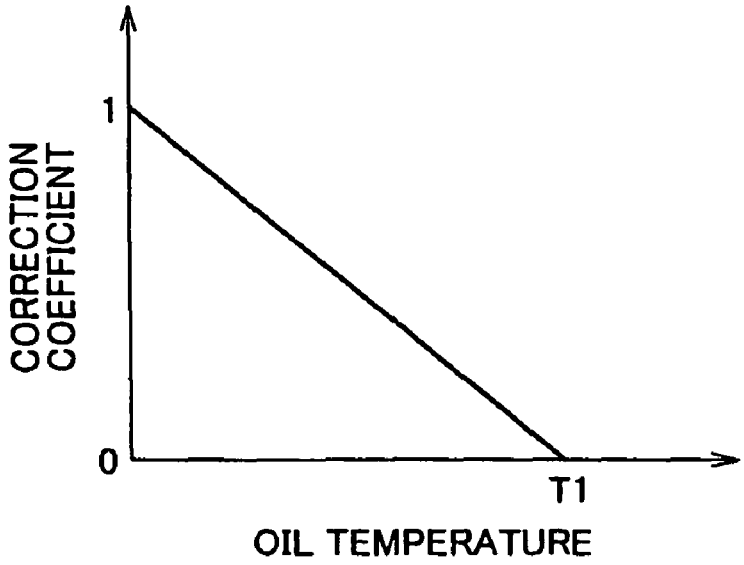
FIG. 13 is a view that illustrates the setting of a correction coefficient used to correct variations in the holding duty learning values in a fourth embodiment of the present invention.

The correction coefficient in equation (18) associated with the temperature of the pressurized oil. FIG. 13 is a view illustrating the relationship between the correction coefficient and the oil temperature. As shown in this figure, the correction coefficient is set to 0 if the oil temperature is equal to or above a prescribed temperature T1. If the oil temperature is below the prescribed temperature T1, the correction coefficient is set closer to 1 as the oil temperature decreases. By setting the correction coefficient in this manner, the holding duty learning value approaches the control reference duty if the oil temperature is equal to or above the prescribed temperature T1. However, if the oil temperature is below the prescribed temperature T1, the control reference duty approaches the OCV center duty as the oil temperature decreases.

Figure 14:
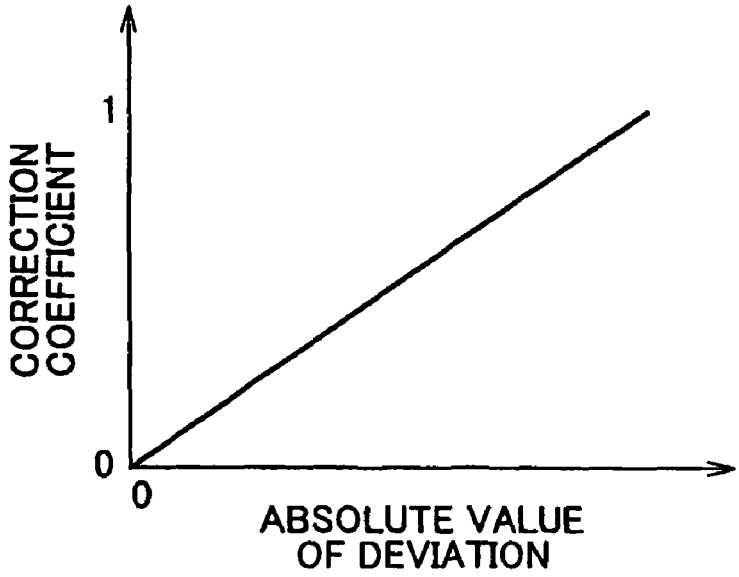
FIG. 14 is a view that illustrates the setting of a correction coefficient used to correct variations in the holding duty learning values in the fourth embodiment of the present invention.

Furthermore, the correction coefficient in equation (18) associated with the absolute value of the deviation between the controlled displacement angle of the hydraulic actuator 20 and the target displacement angle. FIG. 14 is a view illustrating the relationship between the correction coefficient and the absolute value of the deviation. As shown in this figure, the correction coefficient approaches 1 away from 0 as the absolute value of the deviation increases. By setting the correction coefficient in this manner, the holding duty learning value becomes the control reference duty if the deviation is equal to zero. In contrast, the control reference duty approaches the OCV center duty as the absolute value of the deviation increases.

When the oil temperature is kept low, the pressurized oil has an increased viscosity, thereby causing variations in the operation of the hydraulic actuator 20. Because the holding duty learning value is learned while controlling the operation of the hydraulic actuator 20, the variations in the operation of the hydraulic actuator 20 reduces the learning accuracy of the holding duty learning value. However, in the present embodiment, the control reference duty approaches the OCV center duty as the oil temperature decreases. Therefore, it is possible to prevent occurrence of variations in the control reference used in duty-controlling the OCV 10.

Furthermore, the greater the absolute value of the deviation between the controlled displacement angle of the hydraulic actuator 20 and the target displacement angle, the more sensitive the response of hydraulic actuator 20 is to changes in the OCV drive duty. For this reason, if variations exist in the control reference used in duty-controlling the OCV 10, the influence of the variations on the operation of the hydraulic actuator 20 increases. However, in the present embodiment, the control reference duty approaches the OCV center duty as the absolute value of the deviation increases. Therefore, it is possible to suppress the influence of the learning accuracy of the holding duty learning value on the control characteristics of the hydraulic actuator 20 even when the learning accuracy of the holding duty learning value is not fully assured.

In the present embodiment, when the control unit 40 calculates the control reference duty, the function of the "control signal setting unit" of the invention may be implemented by setting the correction coefficient in accordance with the oil temperature as shown in FIG. 13. Furthermore, the function of the "control signal setting unit" of the invention may be implemented by setting the correction coefficient in accordance with the absolute value of the deviation as shown in FIG. 14.

Although the oil temperature and the absolute value of the deviation are all linked to a single correction coefficient in the present embodiment, it may be possible to provide an oil temperature correction coefficient and a deviation correction coefficient independently of each other. In this case, the oil temperature correction coefficient is set in accordance with the oil temperature as shown in FIG. 13, while the deviation correction coefficient is set in accordance with the absolute value of the deviation as shown in FIG. 14.

Hereinafter, a fifth embodiment of the present invention will be described with reference to the accompanying drawings.

Figure 15A:
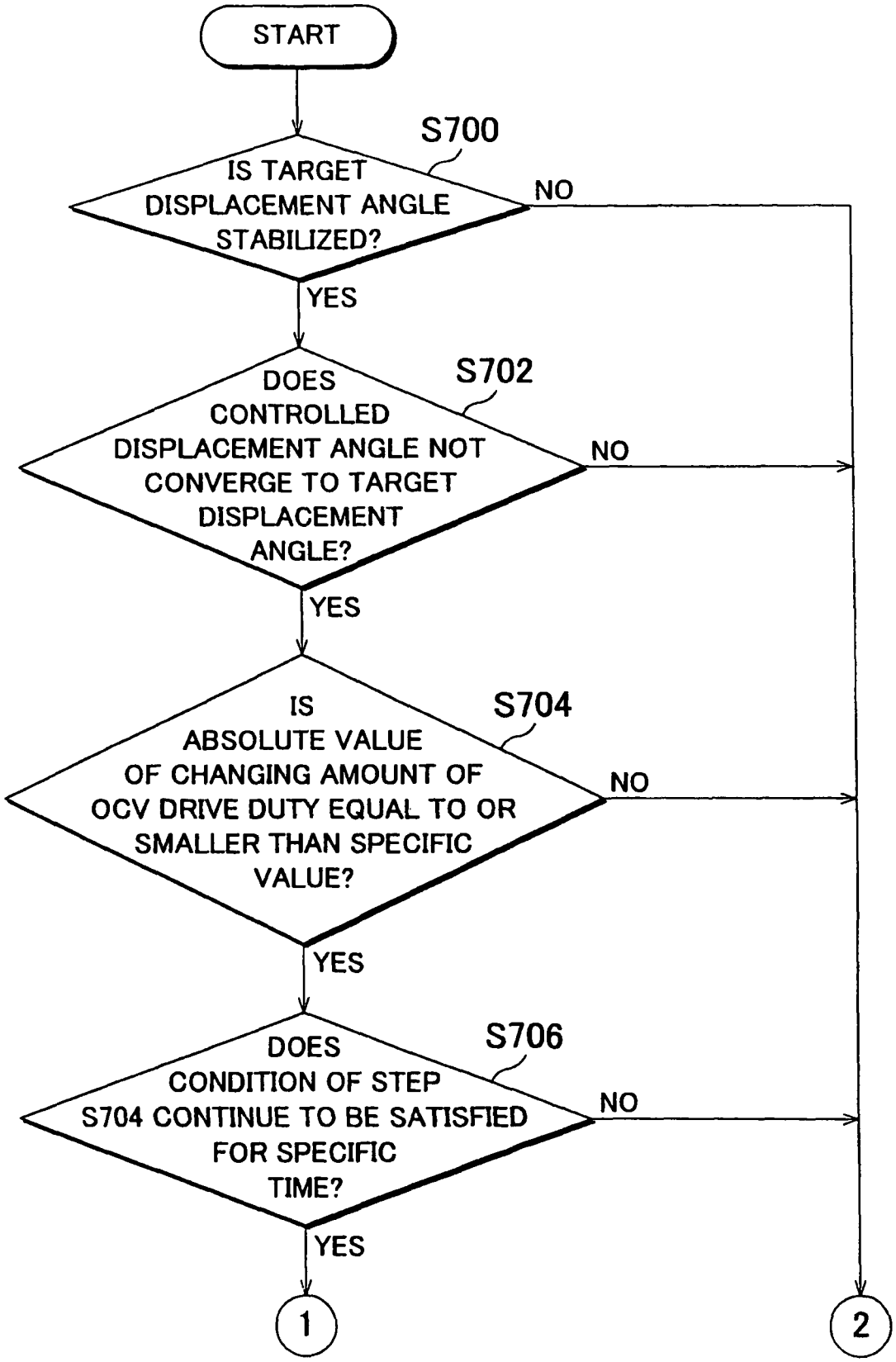
FIGS. 15A and 15B are a flowchart that illustrates the operation for learning an upper end duty and a lower end duty of a dead zone, which is executed in a fifth embodiment of the present invention.
Figure 15B:
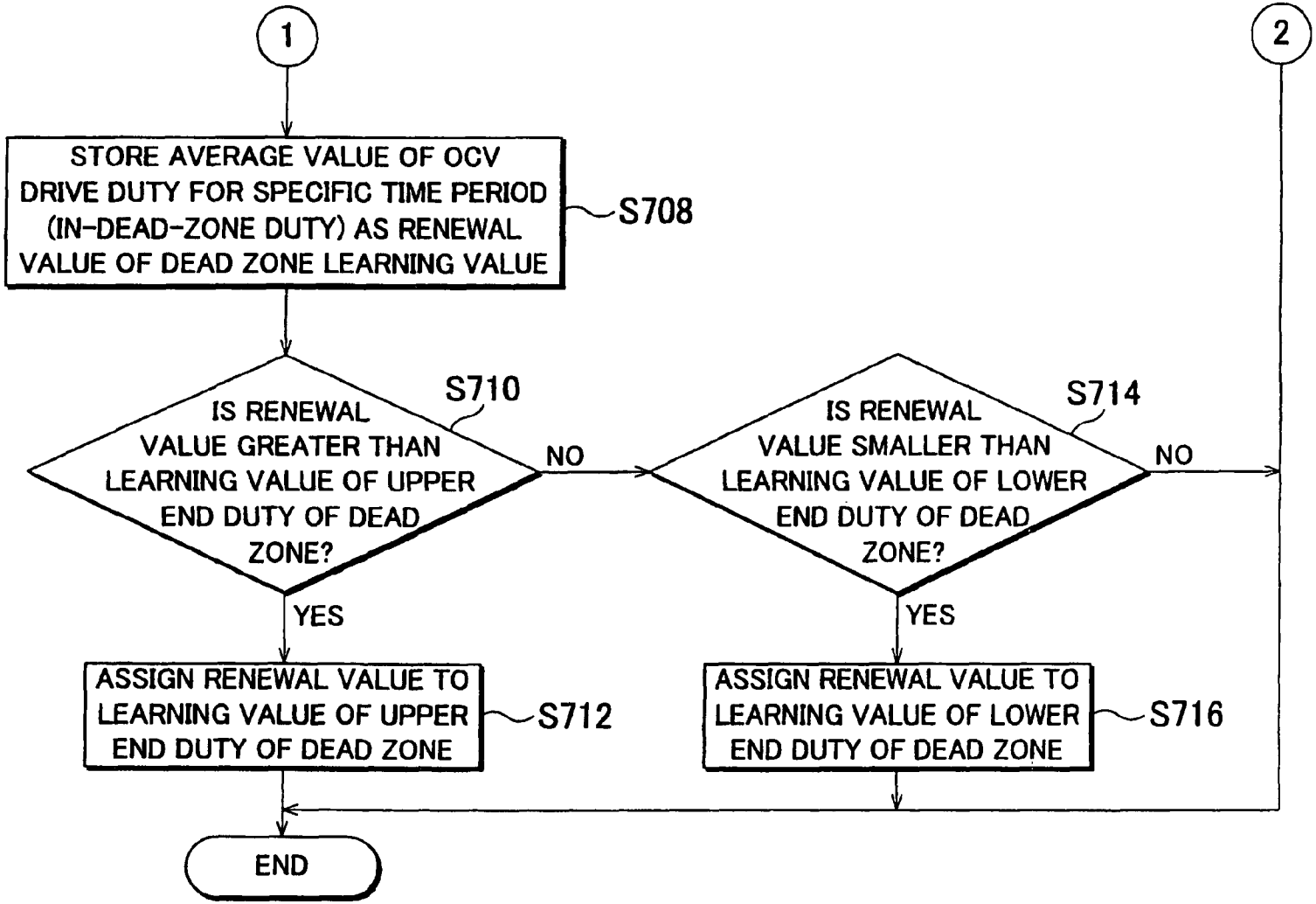

A hydraulic actuator control device of the fifth embodiment of the present invention is similar to the hydraulic actuator control device of the first embodiment, but differs in that it executes the operation shown in the flowchart of FIGS. 15A and 15B in place of the operation shown in the flowchart of FIGS. 7A and 7B. The flowchart of FIGS. 15A and 15B illustrates an operation for learning the upper and the lower end duty of the dead zone of the OCV 10. In the present embodiment, the "dead zone determining unit" of the invention may be implemented by executing the operation shown in FIGS. 15A and 15B with the control unit 40. This operation is periodically executed by the control unit 40.

In step S700 of the operation shown in FIG. 15A, it is determined whether the target displacement angle of the hydraulic actuator 20 has been stabilized. The target displacement angle is determined based on the engine operating state, including factors such as, for example, the engine speed and the engine load. If the amount of change in the target displacement angle within a given time period is smaller than a prescribed value, it is determined that the target displacement angle has been stabilized. The present operation ends if the target displacement angle has not been stabilized.

If it is determined in step S700 that the target displacement angle has been stabilized, the operation proceed to step S702. In step S702, it is determined whether the controlled displacement angle has converged to the target displacement angle. If the deviation between the controlled displacement angle and the target displacement angle is equal to or smaller than a prescribed reference deviation for more than a given time, it can be determined that the controlled displacement angle has converged to the target displacement angle. In this case, it can be determined that the learning values of the upper and the lower end duty of the present dead zone are proper. Thus, the present operation ends if such is the case.

If it is determined in step S702 that the controlled displacement angle has not yet converged to the target displacement angle, the operation proceeds to step S704 where it is determined whether the absolute value of the changing amount of the OCV drive duty is equal to or below a prescribed value. If the absolute value of the changing amount is greater than the prescribed value, the present operation ends.

If the condition of step S704 is satisfied, the operation proceeds to step S706 where it is determined whether the condition of step S704 has continued to be satisfied for a specific time. If the prescribed time has not lapsed from satisfaction of the condition of step S704, the present operation ends.

If the condition of step S706 is satisfied, i.e., if the absolute value of the changing amount of the OCV drive duty has remained below the prescribed value for the prescribed time, it can be determined that the OCV drive duty falls inside the dead zone of the OCV 10. In step S708, an average value of the OCV drive duty for a prescribed time period up to the present time is calculated and temporarily stored in the memory as a updated value of the dead zone learning value. The updated value stored in the memory is updated each time step S708 is executed.

In step S710, it is determined whether the updated value stored in the memory is greater than the present learning value of the upper end duty of the dead zone. If the updated value is greater than the present learning value, the operation proceeds to step S712 where the updated value stored in the memory is set as the learning value of the upper end duty of the dead zone. That is, the upper end duty of the dead zone is updated.

If the updated value is equal to or smaller than the present learning value of the upper end duty of the dead zone, the operation proceeds to step S714 where it is determined whether the updated value stored in the memory is below the present learning value of the lower end duty of the dead zone. If the updated value is equal to or greater than the present learning value, the present operation ends. In contrast, if the updated value is below the present learning value, the operation proceeds to step S716 where the updated value stored in the memory is set as the learning value of the lower end duty of the dead zone. That is, the lower end duty of the dead zone is updated.

As described above, in the present embodiment, the upper and the lower end duty of the dead zone are learned when the target displacement angle of the hydraulic actuator 20 and the OCV drive duty that is output to the OCV 10 are stabilized. By determining satisfaction of these conditions, it is possible to accurately determine whether the OCV drive duty at the present time falls within the dead zone. Furthermore, it is possible to increase the learning accuracy of the dead zone by performing the learning when the OCV drive duty is stabilized. Moreover, the present embodiment learns the dead zone without operating the hydraulic actuator 20. This provides an advantage in that the opportunity of learning the dead zone can be increased, thereby improving the learning accuracy of the dead zone.

The dead zone learning method of the present embodiment may be combined with the conventional OCV drive duty calculating method, namely the method of calculating the OCV drive duty without using the virtual model control valve. As described above, the dead zone learning method of the present embodiment is capable of learning the dead zone with higher accuracy than is available in the conventional learning method. Therefore, as far as the hydraulic actuator control that decides the OCV drive duty based on the dead zone is concerned, it is possible to improve controllability of the hydraulic actuator by applying the dead zone learning method of the present embodiment thereto.

In the present embodiment, the "dead zone determining unit" of the invention may be implemented by executing the operation shown in FIGS. 15A and 15B with the control unit 40. Furthermore, the "control signal setting unit" of the invention may be implemented by setting the OCV drive duty based on the dead zone which was specified by executing the operation shown in FIGS. 15A and 15B.

Furthermore, the operation shown in FIGS. 15A and 15B may be modified as follows. As a first modified embodiment, the updated value of the dead zone learning value stored in step S708 may be adopted as the OCV drive duty at the present time. Alternatively, the maximum value or minimum value of the OCV drive duty within a prescribed time period may be adopted as the updated value of the dead zone learning value. As a further alternative, a value obtained by smoothing the OCV drive duty in a time direction (a so-called annealing value) may be adopted as the updated value of the dead zone learning value.

As a second modified embodiment, the controlled displacement angle used for calculation in the operation shown in FIGS. 15A and 15B may be a value obtained by smoothing the same in a time direction (a so-called annealing value) instead of the current controlled displacement angle of the hydraulic actuator 20. This increases the likelihood that the condition of step S702 is satisfied and further increases the opportunity of learning the dead zone, even when the signals of the controlled displacement angle are changed by disturbances such as a fluctuation in rotation of the engine and a noise.

While certain embodiments of the present invention have been described above, the present invention is not limited thereto but may be modified to many different forms without departing from the spirit of the invention. For example, the present invention may be modified as follows.

In each of the foregoing embodiments, the actual OCV in-dead-zone control amount may be corrected in accordance with the temperature of the pressurized oil. This is because the dead zone width of the OCV 10 is increased or decreased by the temperature of the pressurized oil. Instead of correcting the actual OCV in-dead-zone control amount, it may be possible to correct the virtual OCV dead zone width of the model control characteristics in accordance with the temperature of the pressurized oil. This makes it possible to reflect the oil temperature on the actual OCV in-dead-zone control amount through the OCV variation correction coefficient.

The dead zone width of the OCV 10 is increased or decreased not only by the temperature of the pressurized oil but also by the pressure or viscosity of the pressurized oil or the engine speed. This means that it is desirable to correct the virtual OCV dead zone width of the model control characteristics in accordance with the pressure or viscosity of the pressurized oil or the engine speed, as well as the temperature of the pressurized oil. Thus, the effect of these factors on the control characteristics of the hydraulic actuator 20 is minimized.

The present invention is not limited to the variable valve timing mechanism but may be extensively applied to other hydraulic systems that make use of a hydraulic actuator having two oil chambers, the operation of which is controlled by supplying and discharging pressurized oil to and from the respective oil chambers. Furthermore, the control valve for controlling the supply and discharge of the pressurized oil with respect to the hydraulic actuator is not limited to the electromagnetic control valve like the OCV 10 shown in FIG. 1. It may be possible to use a pilot control valve driven by a pilot pressure.

The invention claimed is:

1. A hydraulic actuator control device having a hydraulic actuator operated by supply and discharge of pressurized oil and a control valve that controls the supply and discharge of the pressurized oil to and from the hydraulic actuator, the hydraulic actuator control device controls the hydraulic actuator by outputting a control signal to the control valve, the hydraulic actuator control device comprising:

a dead zone determining unit that determines a dead zone in which the hydraulic actuator does not respond to or shows reduced responsiveness to changes in the control signal;

a holding value setting unit that sets a value of the control signal when an operating speed of the hydraulic actuator becomes zero as a holding value;

a storing unit that stores, as model control characteristics, a changing tendency of responsiveness of the hydraulic actuator to the change in the control signal realized by a virtual model control valve;

a correspondence coefficient calculating unit that calculates a correspondence coefficient, which is a ratio of a width of the dead zone to a width of a model dead zone of the model control characteristics, that is used as a coefficient for causing the control valve of the control device and the model control valve to correspond to each other;

a model holding-value calculating unit that calculates a model holding value, which is the control signal value when the operating speed of the hydraulic actuator becomes zero in the model control characteristics, wherein the control signal value is calculated by using the correspondence coefficient to correct a deviation between a center value of the dead zone and the holding value;

a model control-amount calculating unit that calculates a model control amount, which is a control amount whose reference is the model holding value, based on a deviation between an operating amount and a target operating amount of the hydraulic actuator;

an in-dead-zone control amount calculating unit that calculates an in-dead-zone control amount of the control valve by using the correspondence coefficient to correct a model in-dead-zone control amount of the model control amount falling within the model dead zone;

an out-of-dead-zone control amount calculating unit that calculates an out-of-dead-zone control amount of the control valve, based on a model out-of-dead-zone control amount of the model control amount that falls outside the model dead zone; and a control signal setting unit that sets a control signal that is output to the control valve, based on the holding value, the in-dead-zone control amount and the out-of-dead-zone control amount.

2. The hydraulic actuator control device according to claim 1, wherein, if the hydraulic actuator is operated in a positive direction when the control signal value is set greater than an upper end value of the dead zone, the dead zone determining unit calculates an overshoot amount of an actual operating amount relative to the target operating amount and decreases the upper end value according to the overshoot amount, if the operating amount of the hydraulic actuator exceeds the target operating amount.

3. The hydraulic actuator control device according to claim 1, wherein, if the hydraulic actuator is operated in a negative direction when the control signal value is set smaller than a lower end value of the dead zone, the dead zone determining unit calculates an undershoot amount of an actual operating amount relative to the target operating amount and increases the lower end value according to the undershoot amount, if the operating amount of the hydraulic actuator exceeds the target operating amount.

4. The hydraulic actuator control device according to claim 1, wherein the out-of-dead-zone control amount calculating unit calculates the out-of-dead-zone control amount by correcting the model out-of-dead-zone control amount in accordance with a temperature of the pressurized oil.

5. The hydraulic actuator control device according to claim 1, wherein the in-dead-zone control amount calculating unit corrects the in-dead-zone control amount in accordance with the temperature of the pressurized oil.

6. The hydraulic actuator control device according to claim 1, further comprising a model dead zone width correcting unit that corrects a model dead zone width in accordance with the temperature of the pressurized oil.

7. The hydraulic actuator control device according to claim 1, further comprising a model dead zone width correcting unit that corrects a model dead zone width in accordance with a pressure of the pressurized oil.

8. The hydraulic actuator control device according to claim 1, further comprising a model dead zone width correcting unit that corrects a model dead zone width in accordance with a viscosity of the pressurized oil.

9. The hydraulic actuator control device according to claim 1, further comprising a model dead zone width correcting unit that corrects a model dead zone width in accordance with an engine speed.

10. The hydraulic actuator control device according to claim 1, further comprising a correspondence coefficient correcting unit that decreases the correspondence coefficient if the deviation between the operating amount and the target operating amount of the hydraulic actuator converges within a prescribed range.

11. The hydraulic actuator control device according to claim 1, further comprising an inhibiting unit that inhibits output of the control signal to the control valve until a pressurized oil pressure exceeds a prescribed reference value.

12. The hydraulic actuator control device according to claim 1, wherein the holding value setting unit learns the holding value when controlling the operation of the hydraulic actuator, and wherein the control signal setting unit adopts the learned holding value as a control reference by which to set the control signal and allows the control reference to approach the center value of the dead zone as the pressurized oil temperature decreases.

13. The hydraulic actuator control device according to claim 1, wherein the holding value setting unit learns the holding value when controlling the operation of the hydraulic actuator, and wherein the control signal setting unit adopts the learned holding value as a control reference by which to set the control signal and allows the control reference to approach the center value of the dead zone as an absolute value of the deviation between the operating amount and the target operating amount of the hydraulic actuator increases.

14. A hydraulic actuator control device having a hydraulic actuator operated by supply and discharge of pressurized oil and a control valve that controls the supply and discharge of the pressurized oil to and from the hydraulic actuator, the hydraulic actuator control device controls the hydraulic actuator by outputting a control signal to the control valve, the hydraulic actuator control device comprising:

a dead zone determining unit that learns a dead zone in which the hydraulic actuator does not respond to or shows reduced responsiveness to changes in the control signal; and a control signal setting unit that sets, based on the dead zone, a control signal that is output to the control valve, wherein the dead zone determining unit learns the dead zone without operating the hydraulic actuator when a target operating amount of the hydraulic actuator and a value of the control signal being output to the control valve are stabilized.

15. The hydraulic actuator control device according to claim 14, wherein the dead zone determining unit calculates a dead zone updated value from the value of the control signal according to a specified rule and renews the dead zone updated value with a learning value of an upper end value of the dead zone if the dead zone updated value is greater than the learning value of the upper end value of the dead zone.

16. The hydraulic actuator control device according to claim 14, wherein the dead zone determining unit calculates a dead zone updated value from the value of the control signal according to a specified rule and renews the dead zone updated value with a learning value of a lower end value of the dead zone if the dead zone updated value is smaller than the learning value of the lower end value of the dead zone.

17. A hydraulically-operated variable valve timing device that variably controls valve timing of an intake valve or an exhaust valve of an internal combustion engine, comprising:

a hydraulic actuator operated by supply and discharge of pressurized oil for changing valve timing; and a control valve that controls the supply and discharge of the pressurized oil to and from the hydraulic actuator and a control device that controls the hydraulic actuator by outputting a control signal to the control valve, wherein the control device comprises:

a dead zone determining unit that determines a dead zone in which the hydraulic actuator does not respond to or shows reduced responsiveness to changes in the control signal;

a holding value setting unit that sets the value of the control signal when an operating speed of the hydraulic actuator becomes zero as a holding value;

a storing unit that stores, as model control characteristics, a changing tendency of responsiveness of the hydraulic actuator to changes in the control signal realized by a virtual model control valve;

a correspondence coefficient calculating unit that calculates a correspondence coefficient, which is a ratio of a width of the dead zone to a width of a model dead zone of the model control characteristics, that is used as a coefficient for causing the control valve of the control device and the model control valve to correspond to each other;

a model holding-value calculating unit that calculates a model holding value, which is the control signal value when the operating speed of the hydraulic actuator becomes zero in the model control characteristics, wherein the control signal value is calculated by using the correspondence coefficient to correct a deviation between a center value of the dead zone and the holding value;

a model control-amount calculating unit that calculates a model control amount, which is a control amount whose reference is the model holding value, based on a deviation between an operating amount and a target operating amount of the hydraulic actuator;

an in-dead-zone control amount calculating unit that calculates an in-dead-zone control amount of the control valve by using the correspondence coefficient to correct a model in-dead-zone control amount of the model control amount falling within the model dead zone;

an out-of-dead-zone control amount calculating unit that calculates an out-of-dead-zone control amount of the control valve, based on a model out-of-dead-zone control amount of the model control amount that falls outside the model dead zone; and a control signal setting unit that sets a control signal that is output to the control valve, based on the holding value, the in-dead-zone control amount and the out-of-dead-zone control amount.

18. A hydraulically-operated variable valve timing device that variably controls valve timing of an intake valve or an exhaust valve of an internal combustion engine, comprising:

a hydraulic actuator operated by supply and discharge of pressurized oil for changing valve timing; and a control valve that controls the supply and discharge of the pressurized oil to and from the hydraulic actuator and a control device that controls the hydraulic actuator by outputting a control signal to the control valve, wherein the control device comprises:

a dead zone determining unit that learns a dead zone in which the hydraulic actuator does not respond to or shows reduced responsiveness to changes in the control signal; and a control signal setting unit that sets, based on the dead zone, a control signal that is output to the control valve, wherein the dead zone determining unit learns the dead zone without operating the hydraulic actuator when a target operating amount of the hydraulic actuator and a value of the control signal being output to the control valve are stabilized.

19. A hydraulic actuator control method for a system having a hydraulic actuator operated by supply and discharge of pressurized oil and a control valve that controls the supply and discharge of the pressurized oil to and from the hydraulic actuator, the hydraulic actuator control method controls the hydraulic actuator by outputting a control signal to the control valve, the hydraulic actuator control method comprising:

determining a dead zone in which the hydraulic actuator does not respond to or shows reduced responsiveness to changes in the control signal;

setting a value of the control signal when an operating speed of the hydraulic actuator becomes zero as a holding value;

storing, as model control characteristics, a changing tendency of responsiveness of the hydraulic actuator to the change in the control signal realized by a virtual model control valve;

calculating a correspondence coefficient, which is a ratio of a width of the dead zone to a width of a model dead zone of the model control characteristics, that is used as a coefficient for causing the control valve of the system and the model control valve to correspond to each other;

calculating a model holding value, which is the control signal value when the operating speed of the hydraulic actuator becomes zero in the model control characteristics, wherein the control signal value is calculated by using the correspondence coefficient to correct a deviation between a center value of the dead zone and the holding value;

calculating a model control amount, which is a control amount whose reference is the model holding value, based on a deviation between an operating amount and a target operating amount of the hydraulic actuator;

calculating an in-dead-zone control amount of the control valve by using the correspondence coefficient to correct a model in-dead-zone control amount of the model control amount falling within the model dead zone;

calculating an out-of-dead-zone control amount of the control valve, based on a model out-of-dead-zone control amount of the model control amount that falls outside the model dead zone; and setting a control signal that is output to the control valve, based on the holding value, the in-dead-zone control amount and the out-of-dead-zone control amount.

20. A hydraulic actuator control method for a system having a hydraulic actuator operated by supply and discharge of pressurized oil and a control valve that controls the supply and discharge of the pressurized oil to and from the hydraulic actuator, the hydraulic actuator control method controls the hydraulic actuator by outputting a control signal to the control valve, the hydraulic actuator control method comprising:

learning a dead zone in which the hydraulic actuator does not respond to or shows reduced responsiveness to changes in the control signal; and setting, based on the dead zone, a control signal that is output to the control valve, wherein the dead zone is learned without operating the hydraulic actuator when a target operating amount of the hydraulic actuator and a value of the control signal being output to the control valve are stabilized.

* * * * *